US008348718B2

(12) United States Patent
Martin et al.

(10) Patent No.: US 8,348,718 B2
(45) Date of Patent: Jan. 8, 2013

(54) SERVO STROKING METHOD AND SYSTEM FOR PRODUCING SPECIAL SHAPES

(75) Inventors: Jose L. Martin, St. Louis, MO (US); Russell L. Jacobsmeyer, Labadie, MO (US); Carl A. Mik, St. Louis, MO (US); David M. Moehn, Alton, IL (US); Michael J. Nikrant, Hendersonville, TN (US); Fred L. Derner, Village Ridge, MO (US); Timothy M. Meara, Crestwood, MO (US)

(73) Assignee: Sunnen Products Company, St. Louis, MO (US)

( * ) Notice: Subject to any disclaimer, the term of this patent is extended or adjusted under 35 U.S.C. 154(b) by 443 days.

(21) Appl. No.: 12/778,045

(22) Filed: May 11, 2010

(65) Prior Publication Data

US 2010/0273397 A1 Oct. 28, 2010

Related U.S. Application Data

(63) Continuation-in-part of application No. 11/596,839, filed as application No. PCT/US2005/022233 on Jun. 22, 2005, now Pat. No. 7,727,051.

(60) Provisional application No. 60/582,036, filed on Jun. 22, 2004.

(51) Int. Cl.
*B24B 49/00* (2006.01)

(52) U.S. Cl. ..... 451/5; 451/11; 451/57

(58) Field of Classification Search ..... 451/5, 8–11, 451/14, 57, 51, 61, 27, 76, 108, 119, 124, 451/127

See application file for complete search history.

(56) References Cited

U.S. PATENT DOCUMENTS

| | | | | |
|---|---|---|---|---|
| 4,423,567 | A * | 1/1984 | Raven, III | 451/124 |
| 4,455,789 | A * | 6/1984 | Gehring | 451/156 |
| 4,534,093 | A * | 8/1985 | Jahnke et al. | 29/26 A |
| 4,621,455 | A * | 11/1986 | Sunnen et al. | 451/124 |
| 4,679,357 | A * | 7/1987 | Richter et al. | 451/21 |
| 4,816,731 | A * | 3/1989 | Boulton et al. | 318/569 |
| 4,887,221 | A * | 12/1989 | Davis et al. | 700/181 |
| 5,042,202 | A * | 8/1991 | Klein et al. | 451/124 |
| 5,177,904 | A * | 1/1993 | Nagel et al. | 451/27 |
| 5,426,352 | A * | 6/1995 | Styfhoorn et al. | 318/3 |
| 5,479,354 | A * | 12/1995 | Husslein | 700/180 |
| 6,022,132 | A * | 2/2000 | Schulz | 700/186 |
| 7,189,143 | B2 * | 3/2007 | Klein | 451/11 |
| 7,346,973 | B2 * | 3/2008 | Ooe et al. | 29/563 |
| 2004/0048558 | A1 * | 3/2004 | Suzuki et al. | 451/61 |

* cited by examiner

*Primary Examiner* — Dung Van Nguyen

(74) *Attorney, Agent, or Firm* — Matthews Edwards LLC

(57) ABSTRACT

A servo stroking method and system for honing wherein the cam stroking motion is controlled via combined acceleration and deceleration cam profiles to produce a finite jerk profile, a precision positioning capability for the honing element or elements, and accurate position feedback. The stroking motion is synchronized with one or more other parameters of the honing operation, such as the feed or rotational position of the honing tool, for generating non-cylindrical and special honed shapes such as tapered, barrel, and helical shapes. The cam profile can be selected for example from a simple harmonic profile, a cycloidal profile, a modified trapezoidal profile, a polynomial profile, and a modified sine profile, or a mix of cam profiles. The servo controlled stroker mechanism can include for instance a ball screw mechanism, a linear motor, a fluid cylinder, a chain drive or a belt drive.

17 Claims, 29 Drawing Sheets

SERVO VALVE SYSTEM

CHAIN SYSTEM

LINEAR MOTOR SYSTEM

SERVO STROKING METHOD AND SYSTEM FOR PRODUCING SPECIAL SHAPES

This application is a continuation-in-part of U.S. patent application Ser. No. 11/596,839, filed Nov. 17, 2006 now U.S. Pat. No. 7,727,051, which claims priority to PCT Patent Application Serial No. PCT/US05/22233, filed Jun. 22, 2005, which claims priority to U.S. Provisional Patent Application Ser. No. 60/582,036, filed Jun. 22, 2004.

TECHNICAL FIELD

This invention relates generally to apparatus, methods and systems for effecting and controlling stroking motion for honing and other applications, and, more particularly, to a servo stroking method and system adapted for producing special shapes, including, but not limited to, tapered shapes, barrel shapes, helical grooves, rifling, and the like.

BACKGROUND OF THE INVENTION

The contents and disclosure of U.S. patent application Ser. No. 11/596,839, filed Nov. 17, 2006, as well as PCT Patent Application Serial No. PCT/05/22233, filed Jun. 22, 2005, and U.S. Provisional Patent Application Ser. No. 60/582,036, filed Jun. 22, 2004 are hereby incorporated by reference herein in their entirety.

The main problem in the honing process is related to the position feedback and therefore the derivatives of it (velocity, acceleration and jerk). This problem is presently being solved mostly by using dedicated mechanical systems; where the control is done by setting hard limits locking of any adjusting response or simply offering a faulting output as safety response. This is representative of four bar linkage systems. The fast reciprocating motion makes a close loop control historically difficult and expensive.

The present method and system concept is related to the feedback information offered by the servo system and the optimization process related to system dynamic output (position, velocity and acceleration) and tool performance. The stroking process in a honing machine is the relative motion between the honing tool and the work piece. The material removal is produced by the contact of the honing tool with the work piece. The present method and system is related to the significant simplification by using current digital control systems and various schemes to transfer rotational to linear mechanical systems (crank mechanism, four bar linkage). This control process is not limited to a ballscrew application as linear motion mechanism. It could be implemented in any system where the control feedback offered the dynamic output information. Examples of other applications for this process are machine tools where reciprocation is obtained by hydraulic cylinders controlled by a servo valve and position controlled by a linear encoder, and a servo motor link to a chain as motion transfer element.

The following lists are a simplified summary of other known honing systems' limitations and problems.

Known Honing Machine Stroking Technology:

1. Stroking output limited by moving mass.
2. Stroking system independent of feed or spindle system (very limited input/output relation to rest of machine).
3. Slow positioning feedback, position error.
4. Relative "geometry correction" depending on measuring last part to make system adjustments in next process part.
5. Slow pre and post process operations.

6. No operational changes depending on tooling or external variables.
7. Unique motion profile.
8. Limited stroke range.
9. Slow and complex dwell system.
10. Relative crosshatch angle.
11. No tool crash protection.
12. No safety control.
13. Complex mechanical system, two independent systems one to position and another one to stroke.

A review of known patents illustrates how the use of electronic/feedback technology is wide spread throughout the machine tool industry. The specifics of the claims of these patents are related to the control and power transmission of this technology to improve or create new processes. The time line of these claims are not related to novel mechanical inventions but to the digital and control improvements produced in systems control and therefore in the machine tool industry. The use of already existent mechanical subsystems and its implementation produced improvements in the final output. Prior art is presented the following example U.S. patents:

| | | |
|---|---|---|
| C. Tuckfield. | | |
| 755,416 | circa 1904 | "Mechanism for converting reciprocating into rotary motion and vice versa" |
| National Automatic Tool Company Inc. | | |
| 3,126,672 | circa 1964 | "Vertical Honing Machine" |
| Barnes Drill Co. | | |
| 3,404,490 | circa 1968 | "Honing Machine with automatic force control" |
| Siemens Aktiengesellschaft | | |
| 3,664,217 | circa 1972 | "Method and system for digital subdivision of the tool feed travel of a numerically controlled machine tool" |
| Sunnen Products Company | | |
| 4,035,959 | circa 1977 | "Cam operated automatic control for a honing machine" |
| Hitachi Ltd. | | |
| 4,143,310 | circa 1979 | "Apparatus for positioning" |
| Rottler Boring Bar Co. | | |
| 4,189,871 | circa 1980 | "Honing machine" |
| Hitachi Ltd. | | |
| 4,418,305 | circa 1983 | "Velocity Feedback Circuit" |
| Alfred J. Raven III. | | |
| 4,423,567 | circa 1984 | "Power stroking honing machine and control apparatus" |
| Maschinenfabrik Gehring GmbH | | |
| 4,455,789 | circa 1984 | "Self-controlled honing machine" |
| Textron Inc. | | |
| 4,534,093 | circa 1985 | "Beo-type Machining System" |
| Maschinenfabrik Gehring GmbH | | |
| 4,679,357 | circa 1987 | "Method and apparatus for displacing a honing tool" |
| Delapana Honing Equipment Limited | | |
| 4,816,731 | circa 1989 | "Honing Machine" |
| Caterpillar Inc. | | |
| 5,426,352 | circa 1995 | "Automatic honing apparatus" |
| HMR GmbH | | |
| 5,479,354 | circa 1995 | "Method for the computer-assisted control of a machine or process" |

Each of the above mentioned patents are representative of improvements in the machine control system. Most illustrative of early systems is U.S. Pat. No. 755,416 C. Tuckfield "Mechanism for converting reciprocating into rotary motion and vice versa", which shows the cycle motion repetition produced by the cam profile. Also, with the same importance are the U.S. Pat. Nos. 4,143,310 and 4,418,305, Hitachi's "Apparatus for positioning" and "Velocity Feedback Circuit"; where the main improvement is related to the feedback position and velocity, offering control and total dynamic system information. U.S. Pat. No. 4,816,731 "Honing Machine" by Delapena Honing Equipment Limited, clearly represented the use of digital control technology in a honing machine. The to same control is representative of the machining process in other equipment where the limitations were established by the control development not by the process. The mentioned patent clearly addresses all the actual honing technology problems except points 7 and 11 above. These two points are limited in their concept. The complete concept is itself limited by the technology utilized being in principle as slow as their control loop. U.S. Pat. Nos. 4,816,731, 4,621,455, 4,455,789, and 4,423,567 each represent a honing machine where there is a relative motion between the honing tool and the work piece. Also, the honing tool is expanding radially at the same time that it rotates. The removal of material is therefore produced by the honing tool surfaces being harder than the work piece.

In U.S. Pat. No. 4,816,731, column 7, lines 17 to 44, a unique motion profile is described. This motion profile is sectioned in 6 sub cycles: Forward acceleration, forward steady speed, forward deceleration, backward acceleration, backward steady speed, and backward deceleration. This acceleration profile per cycle produces uncertainties in the jerk output. These uncertainties are reflected in the position profile with inconsistency and vibrations throughout the mechanical components. This position error is clearly encountered by the honing machine of U.S. Pat. No. 4,816,731 (column 8, lines 1 to 14). The vibrations problem is also controlled by reducing possible output. This is described in column 6, lines 15 to 22. The problem is underlined on page 25, section 2.5 of "Cam Design and Manufacturing Handbook" by Robert L. Norton. It says "If we wish to minimize the theoretical peak value of the magnitude of the acceleration function for a given problem, the function that would best satisfy this constraint is the square wave . . . " This function is also called constant acceleration. This function is not continuous. It has discontinuities at the beginning, middle and end of the interval. So by itself, is unacceptable as a cam acceleration function."

A schematic representation of this motion profile is shown in FIG. 1 of the drawings. As represented in FIG. 1, the discontinuities of the acceleration function produce an infinite jerk output that violates the cam design corollary. In cycling motion, J1 and J6 are removed, given that the motion is linking from cycle to cycle. The other four discontinuities make the usage of this motion profile very limited.

The honing process is typically used to generate a straight bore or hole. This is a practical approach to the manufacturing process; the best practice would be a straight cylindrical shape under working conditions and with a uniform surface topology to ensure optimum lubricating conditions, usually achieved with a constant crosshatch through the to entire working bore. However, there are some applications, due to some physical change, for example thermal growth, assembly loads, bolts preload, etc., for which a different shape, that is, a non-cylindrical shape for at least a portion of the bore, would be better. Representative examples of special or non-cylindrical shapes include, but are not limited to, a taper running in a particular direction in all or part of the bore, or a barrel shape. For example, a honed bore having a barrel shape along at least a portion of the bore, as a result of being restrained in its functional operating environment may change to a cylindrical shape. And, there are also some applications wherein the working conditions of the work piece would be enhanced by a bore having a special shape, e.g., taper, barrel, etc. Other special shapes, including, but not limited to helical grooved shapes, rifling, and the like, are also desirable for some applications.

Currently in honing, some special or different shapes other than cylindrical can be generated by manually dwelling the honing tool and reducing the length of the honing stroke in the region of the special shape. A problem encountered with this approach is that it is not necessarily accurate in positioning and time so the finished part may not be within surface or geometry specifications.

Another manner of honing special shapes is by the oscillation of the honing tool, that is, reciprocatingly expanding and retracting of the honing element or elements, e.g., abrasive stone or stones during the stroking motion. For example, to generate a straight taper in the work piece, the honing tool is expanded as it is moved toward the larger end of the region of the bore, and then retracted as it is moved toward the smaller end. This expansion and contraction will typically be done during every stroke. However, a problem encountered with this approach is that the tooling required to expand and retract the stones accurately are very complex and is almost impossible to make in a small diameter. And, again, the ability to accurately control the position of the honing elements limits what surface and geometry specifications that can be met.

Thus, what is sought is a method and system which overcomes one or more of the problems and shortcomings set forth above.

SUMMARY OF THE INVENTION

The servo stroking system technology of the present invention is intended to overcome one or more of the problems and shortcomings set forth above.

In a preferred aspect of the present invention, the reciprocation of a honing tool is to based on a digitalized motion profile representative of one cycle. This profile is optimized to maximize the force applied by the honing tool minimizing the reaction in the structural machine components. This optimization process is not related to the machining process orientation. That is, the same optimization process can be used for a vertical or horizontal process. The main difference will be represented in the addition of the gravity force as input in the vertical case. The optimization is based in the fundamental law of Cam Design. "The jerk function must be finite across the entire interval." This principle has been in use in Sunnen's honing machines for the last 50 years. In those machines, the principal is mainly implemented by a predetermined center offset within a four bar linkage. Therefore, the reciprocation frequency is established by the rotation speed of the offset point; and the reciprocation displacement of the slider is determined by the pivoting point location. This scheme control is very efficient given that the dynamic profiles are optimized by the use of the simple harmonic cam profile. This profile offers a very good output for short displacements.

The motion control of the present invention will be limited by the systems variables to be optimized (cycle time, profile acceleration, tool performance, material removal, system vibrations). In the same way, the control protocol will be modified to most accurately represent system constraints (work part physical characteristics, honing machine and reciprocation characteristics). To improve performance, the honing process will be divided into subsets where every subset could require an optimized process or profile. Examples of this include the following:

To divide work part honing cycle into process steps: roughing and finishing. The roughing process will be concentrated in total material removal and bore shape and finishing will be concentrated in surface finish, hatching angle and final size and bore shape. This control scheme is not new but the implementation will be new by using the motion profile that best matches the application. As an example, in the roughing period, profiles with high radial velocity and controlled high acceleration could be used. In the finishing period, profiles with smooth and minimized acceleration and jerk profiles could be used.

As another example, in vertical applications the acceleration profile could be non symmetrical to ensure that the honing tool and machine components encountered a symmetrical force input in both directions, therefore compensating for the gravity input.

Another example is tandem parts (FIG. 2.) Every one of the bore sections has a different size or finish requirements (hatch angle, size, tolerance . . . ) and with the present invention, the honing process or profile can be optimized for each bore section.

Still another example is multi part honing, wherein every part has different requirements. The present invention can be utilized to improve the total machine output by removing setup time for each work part. Instead, a desired honing profile for a part for achieving desired characteristics is selected.

The servo system stroke of the invention is based on a parametric profile curve; this motion profile curve will be scaled depending on the specific stroke length. The reciprocation is based on a digitalized motion profile representative of one honing cycle. That is, one stroke in a first direction, and a return stroke in the opposite direction. This profile can be optimized to maximize the force applied by the honing tool, minimizing the reaction in the structural machine components. This optimization process is not related to the machining process orientation. The same optimization process will be done for a vertical or horizontal process. The main difference will be represented in the addition of the gravity force as input in the vertical case. The optimization is based on the fundamental law of Cam Design. "The jerk function must be finite across the entire interval."

The present servo system preferably uses a directly coupled system to reduce the number of variables and uncertainties. The motion profile uncertainty is therefore reduced to one joint, a ball nut in the instance wherein the servo is a ball screw. Therefore, the position accuracy is increased substantially.

The motion profile produces a variable position, radial speed and acceleration curve throughout the entire profile. The only necessary limiting factor is set as a safety control for the machine structure integrity. Therefore the process decision is limited to a stroke length, stroke rate and spindle speed to achieve the desired cross-hatch angle and removal rate. The cross-hatch angle can be optimized by synchronizing the spindle motion with the stroker. This relation can be in the same way applying to the tool feed or any other machine servo system.

As another preferred aspect of the invention, The present servo stroker relates the control scheme of the stroker to an independent controller/drive unit, where inputs are related to stroke length, position of stroke, start stroking process and stop stroking process. Therefore the positioning scheme is simplified, thereby reducing operation time. This change increases the reaction time significantly. The motion profile curve is independently verified and controlled from the rest of the machine operation increasing total throughput. This improvement is reflected in system performance by increasing stroke rate output. Two different systems have been tested where the stroker rate (given the mechanical system limitations) got as high as 10 cycles per second for a 25.4 mm stroke. Therefore the to refreshing time of the stroker position is 0.2 msec. with a 400 times cycle position check system and 0.09 msec. with a 1024 cycle position check system. The position check table is related to a series of different optimized motion profiles. These profiles are explained in more detail below. Every one of these profiles are parameterized and related to an absolute position.

As a result of reducing the variables and uncertainties in the honing process and using the motion profiles of the invention, particularly controlling the stroking motion using combined acceleration and deceleration profiles to limit jerk to a finite value, very precise control, accuracy and repeatability of the movements of the honing elements throughout the stroking motion, including at the end points or turning points of the stroke, can be achieved. This has been found to make it possible to use the stroking system in combination with the other aspects or drives of a honing machine, to accurately hone surfaces to non-cylindrical or special shapes. Exemplary shapes that can be generated include tapered shapes, barrel shapes, hourglass shapes, rifling, helical grooved shapes, axial grooves, and combinations of these. The other aspects of a honing machine used can include the feed drive, including feedback information generated by associated sensors, such as encoders, resolvers, etc., including the lateral or radial position or displacement of the honing element or elements relative to the rotational axis of the honing tool, and feed force exerted by the honing element or elements against the surface being honed. Information generated by and representative of operating parameters of the spindle drive can also be used, particularly, rotational position, rotational speed, and power or energy consumption, which can also be representative of resistance to rotation, feed force and work piece size, e.g., diameter, and the like. This information can be used according to the invention for generating a three axis control model of the honing process (stroke, feed, spindle) which will be used for precisely controlling the position and movements of the honing element or elements, that is, stroking motion, feed, and rotation, for generating non-cylindrical or special shapes.

As an exemplary example, to generate a taper on a surface defining a bore or hole in a work piece, the controller can be programmed to precisely progressively or gradually shift or move one or both of the end points of the honing stroke during all or a portion of the honing process. For instance, for generating a uniform taper along the entire length of the work piece, the entire stroke may be shifted toward the larger end of the taper. As another approach, just one end point of the stroke may be moved or shifted, to shorten the stroke and increase the honing or material removal rate in the tapered region. In either instance, using the servo controlled capabilities of the invention, the end point shifts or movements will be controlled very precisely, such that the moving end point (or points) combined with the changing feed position of the honing elements will follow or define a profile of the non-cylindrical surface being generated. Feed rate and/or force and rotation speed can remain constant throughout the honing cycle, or can be adjusted.

A non-linear shape, e.g., taper, barrel, or bell shape, can be generated using a non-linear rate of change of end point, either alone, or in combination with a change in a feed or rotational speed parameter. For an hourglass shape, essentially two tapers at the opposite ends of the work piece are generated. To generate a barrel shape, the center of the stroke will remain at one position and both end points of the stroke will be gradually shortened, at the same rate if symmetrical, or at different rates if non-symmetrical. For some shapes, particularly shorter barrel shapes, shorter length honing elements may be required.

As another capability of the invention, the reciprocal stroking movement can be effected by stroking of the work piece relative to the honing tool, or the tool relative to the work piece. This can be effected by holding the spindle carriage stationary, and generating the stroking motion with a device that holds the work piece. As another capability, the work piece can be first honed normally to obtain a starting surface having a cylindrical shape and/or a uniform or base size, for instance, to remove imperfections and excess material, prior to generating the non-cylindrical or special shape.

As another capability, the shortening of the honing stroke can be based on different criteria or parameters. One option is to decrease the stroke length based upon the feed position at some time during the honing cycle. For example, since the amount stock to be removed will typically be known at the beginning of the cycle, the stroke can be reduced from start length to the desired final length proportional to where the feed position is relative to the start diameter and the final diameter. Measurements of actual bore size and/or profile can be made in process or periodically, to enable accurately determining material removal requirements.

Another capability is to reduce the stroke length based on cycle time. For example, if running the cycle for a set time, the stroke would reduce at a constant or other rate until the end of the cycle to the final stroke length. As a result, because the stroke is shorter but the cycle time is fixed, more material is removed from the surface areas honed for the longer time periods and thus they will be larger in diameter.

The ability to precisely control the stroking position according to the invention in combination with precise control the rotational position and movements of a honing tool also to enables producing helical shapes, such as rifling, including with a variable pitch. The honing element or elements will typically be small, corresponding to the size of the helical groove in the surface, and the honing stroke and a simultaneous slow rotation to produce a helical or twisted shape may have to be precisely repeated in terms of position, velocity, acceleration and deceleration, hundreds or thousands of times. Because it is possible to remove only small amounts of material or no material in a single pass, very precise shapes, pitch angle and depth can be achieved.

DETAILED DESCRIPTION OF PREFERRED EMBODIMENTS OF THE INVENTION

Figure 1:
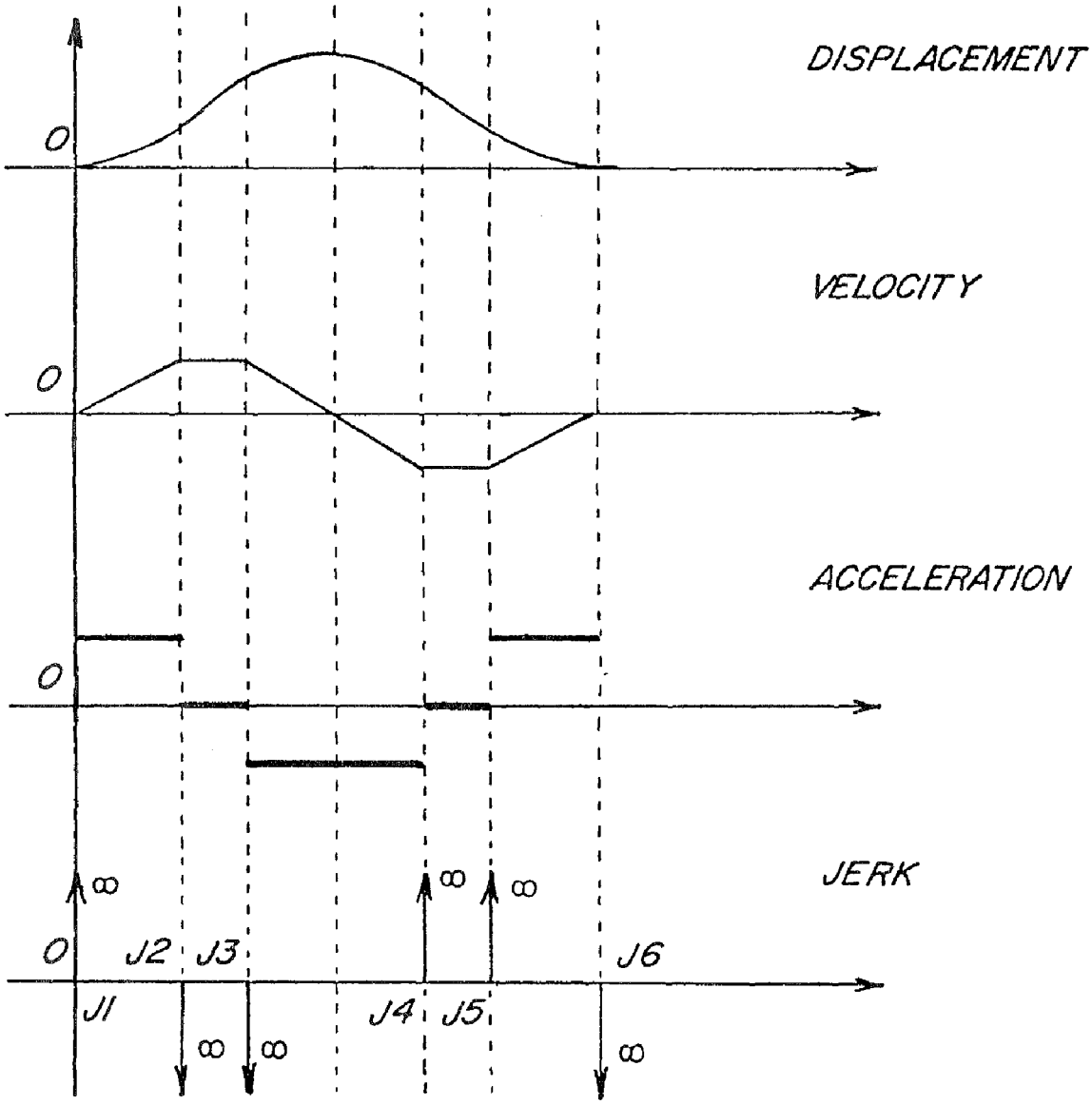
PRIOR ART Fig. 1
FIG. 1 is a graphical representation of displacement, velocity, acceleration, and jerk profiles for a prior art feed control system.
Figure 2:
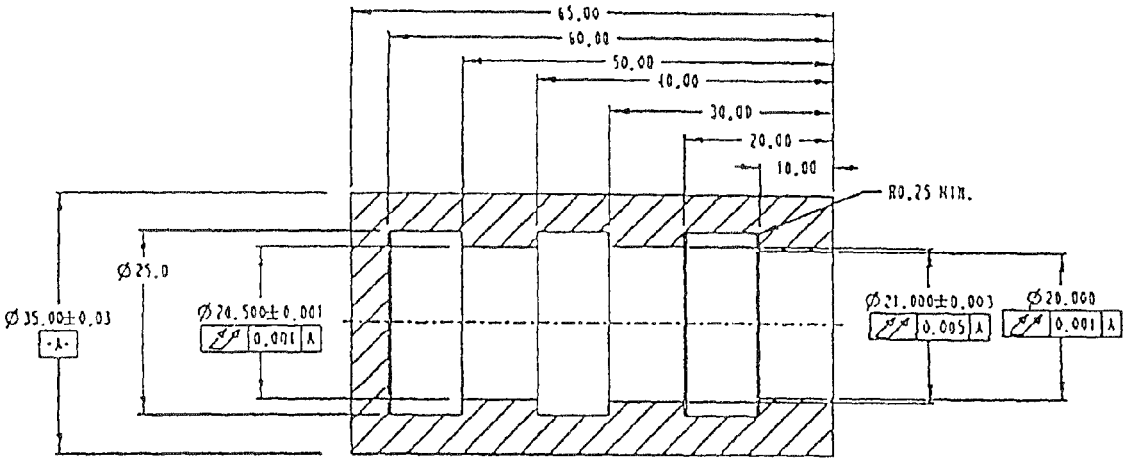
FIG. 2 is a fragmentary sectional representation of a representative work piece having tandem surfaces to be honed.
Figure 3:
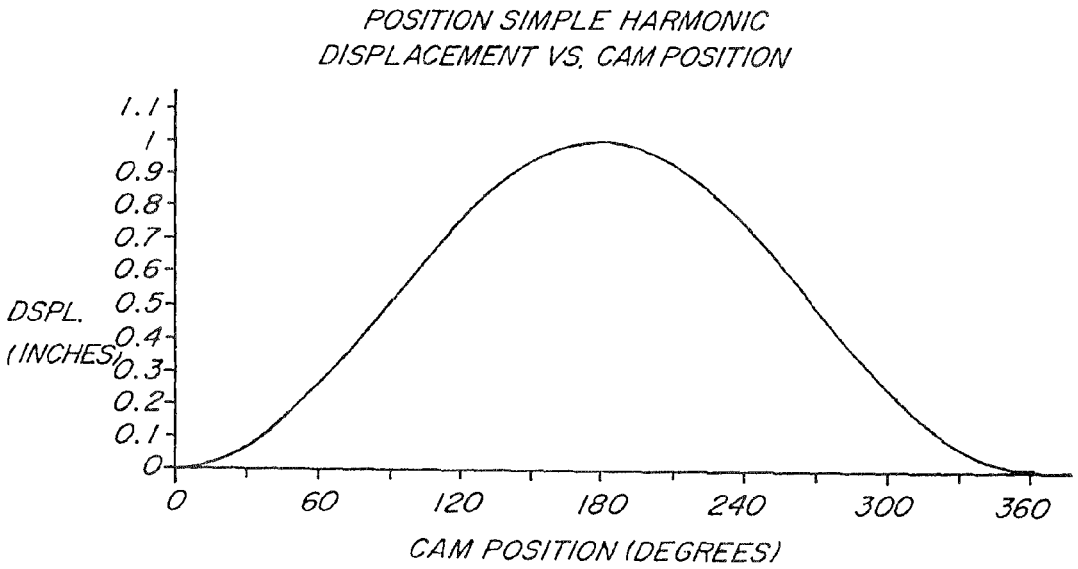
FIG. 3 is a simplified graphical representation of a displacement profile for a simple harmonic cam profile.
Figure 4:
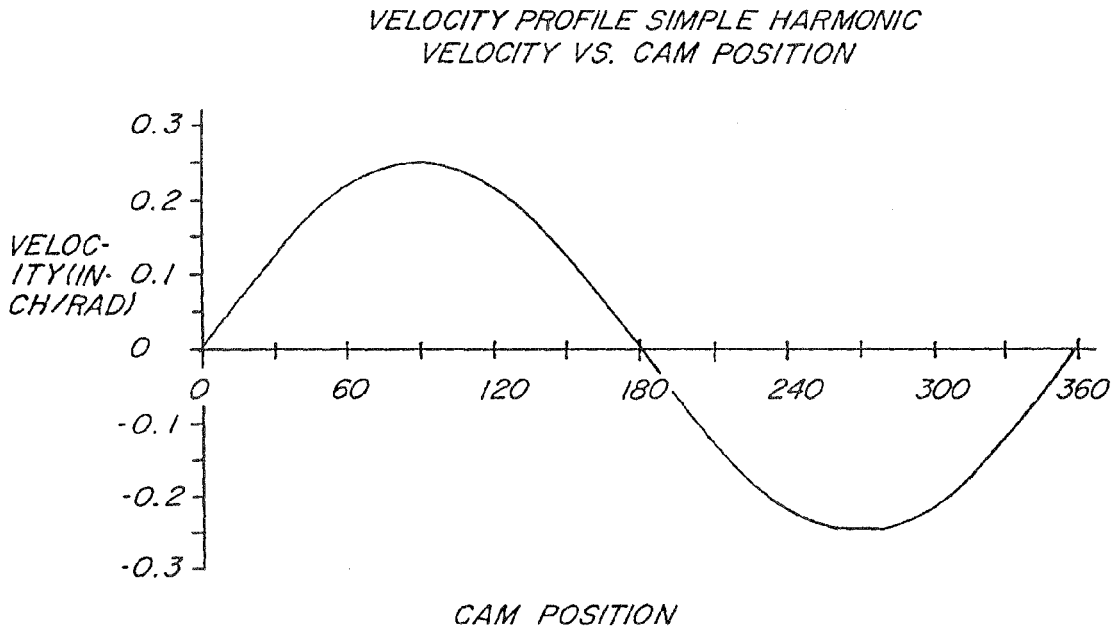
FIG. 4 is a simplified graphical representation of a velocity profile for a simple harmonic cam profile.
Figure 7:
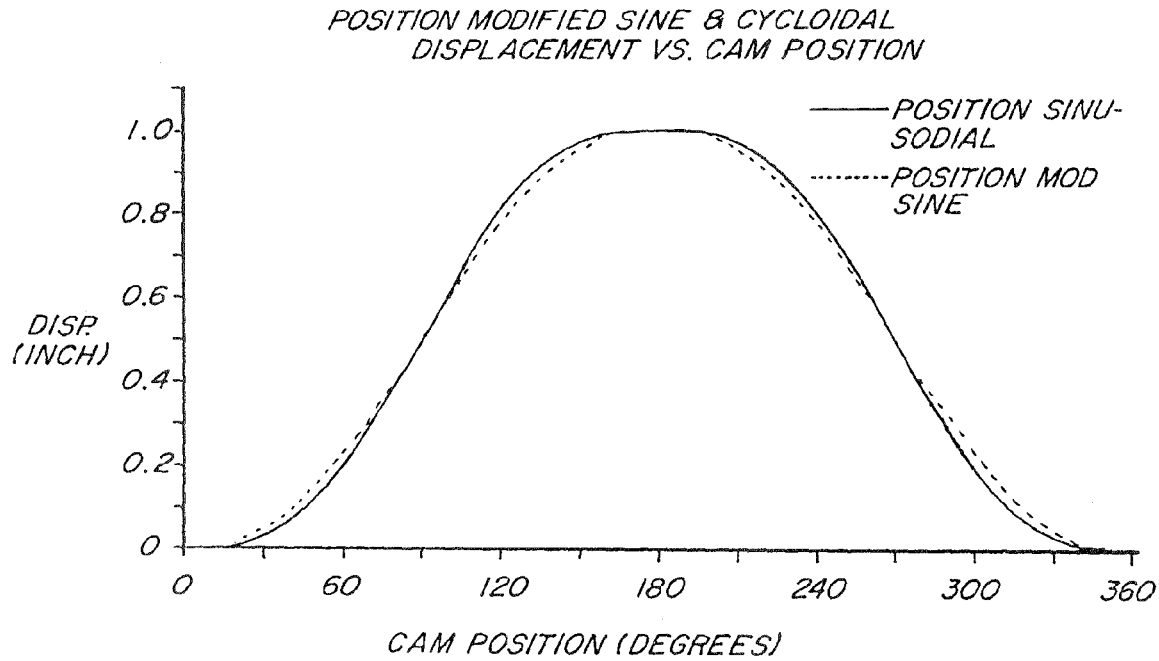
FIG. 7 is a simplified graphical representation of position profiles for modified sine and cycloidal cam profiles.
Figure 5:
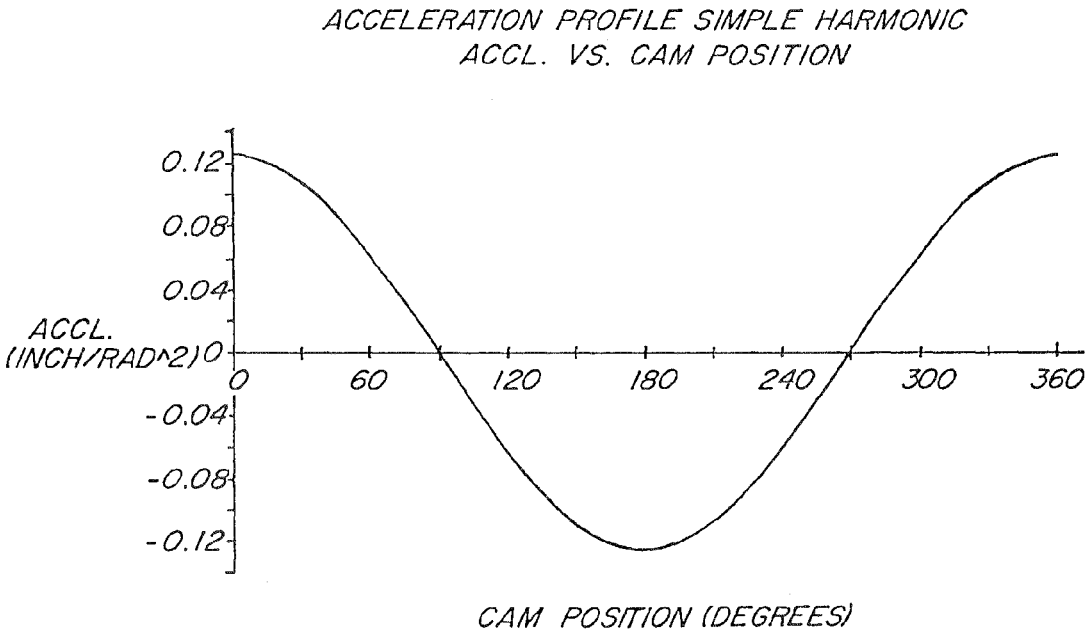
FIG. 5 is a simplified graphical representation of an acceleration profile for a simple harmonic cam profile.
Figure 6:
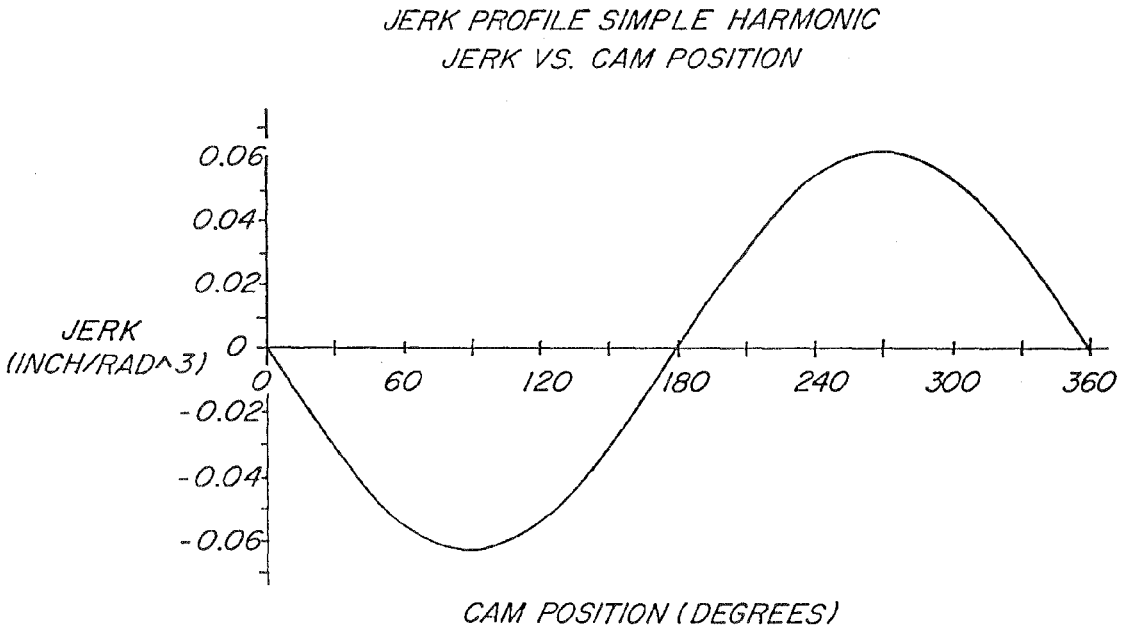
FIG. 6 is a simplified graphical representation of a jerk profile for a simple harmonic cam profile.
Figure 8:
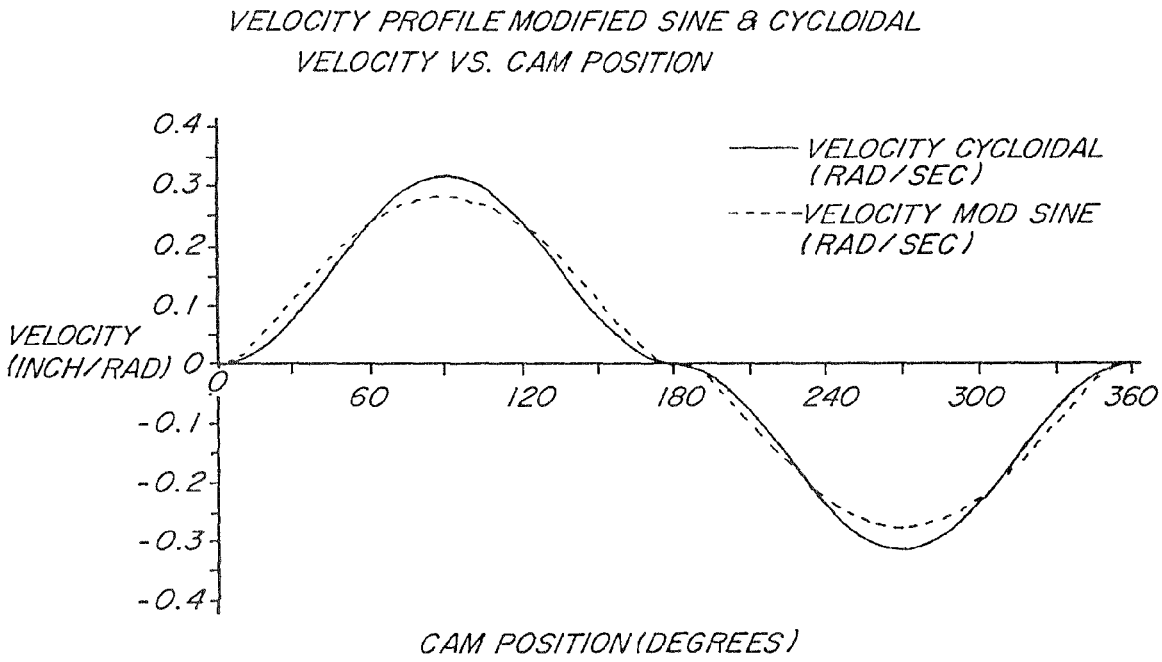
FIG. 8 is a simplified graphical representation of velocity profiles for modified sine and cycloidal cam profiles.
Figure 9:
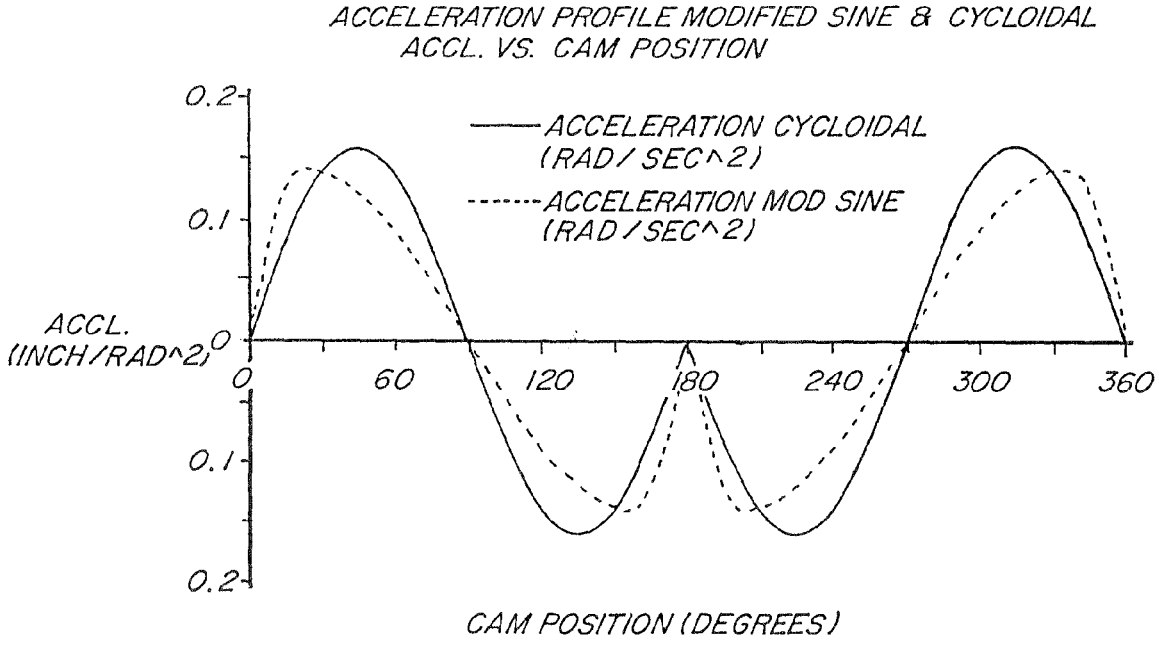
FIG. 9 is a simplified graphical representation of acceleration profiles for modified sine and cycloidal cam profiles.
Figure 10:
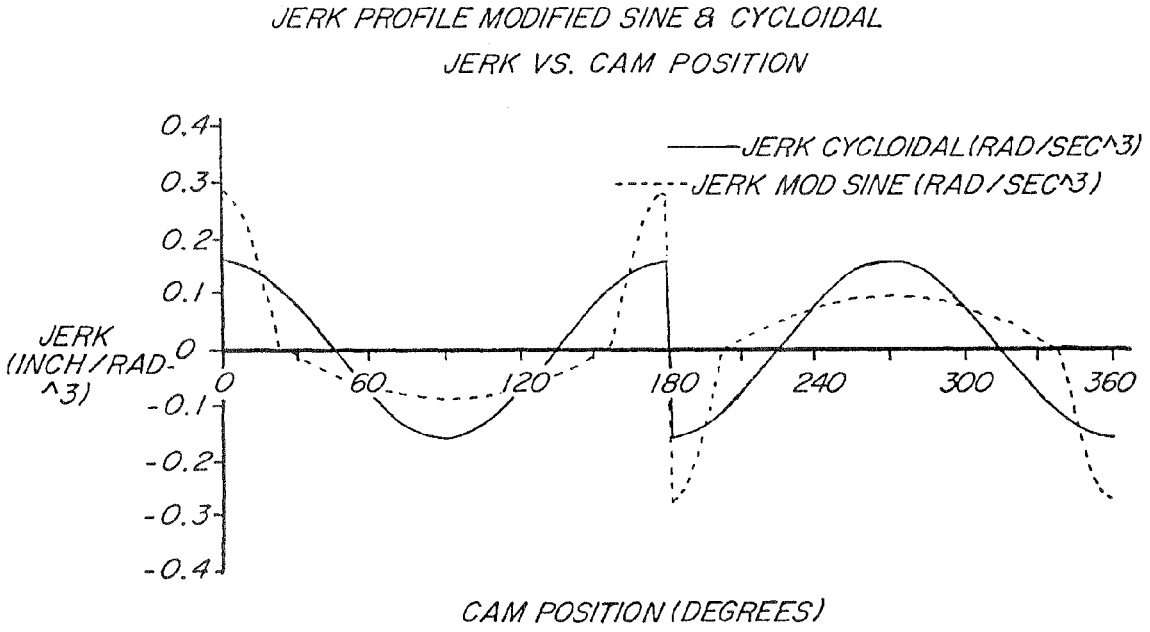
FIG. 10 is a simplified graphical representation of jerk profiles for modified sine and cycloidal cam profiles.
Figure 11:
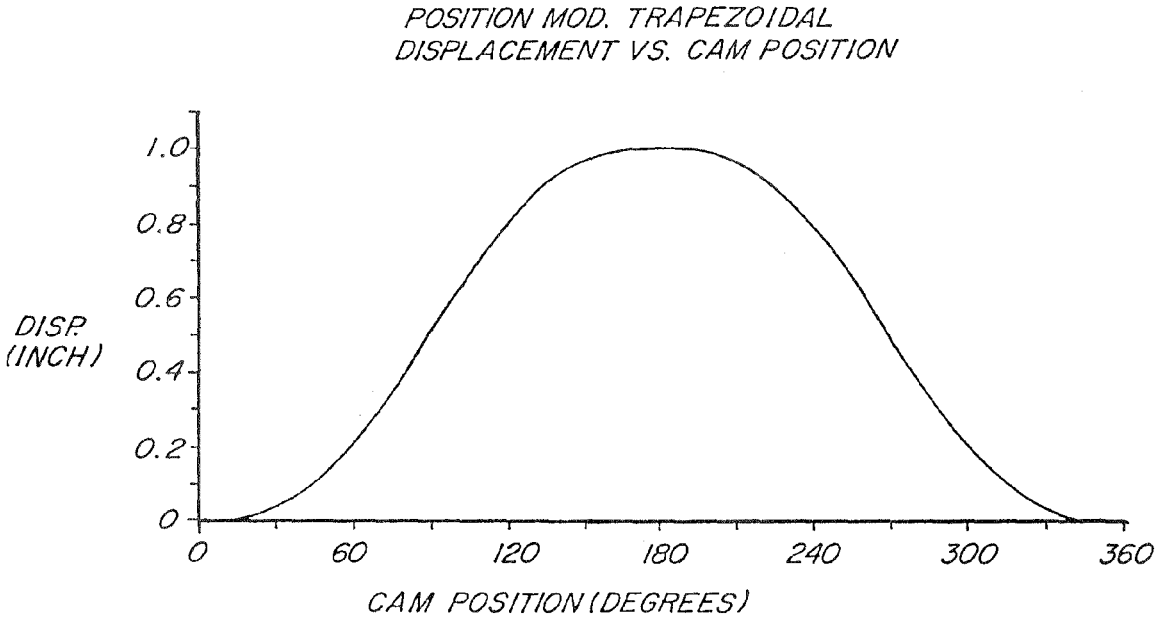
FIG. 11 is a simplified graphical representation of a position profile for a modified trapezoidal cam profile.
Figure 12:
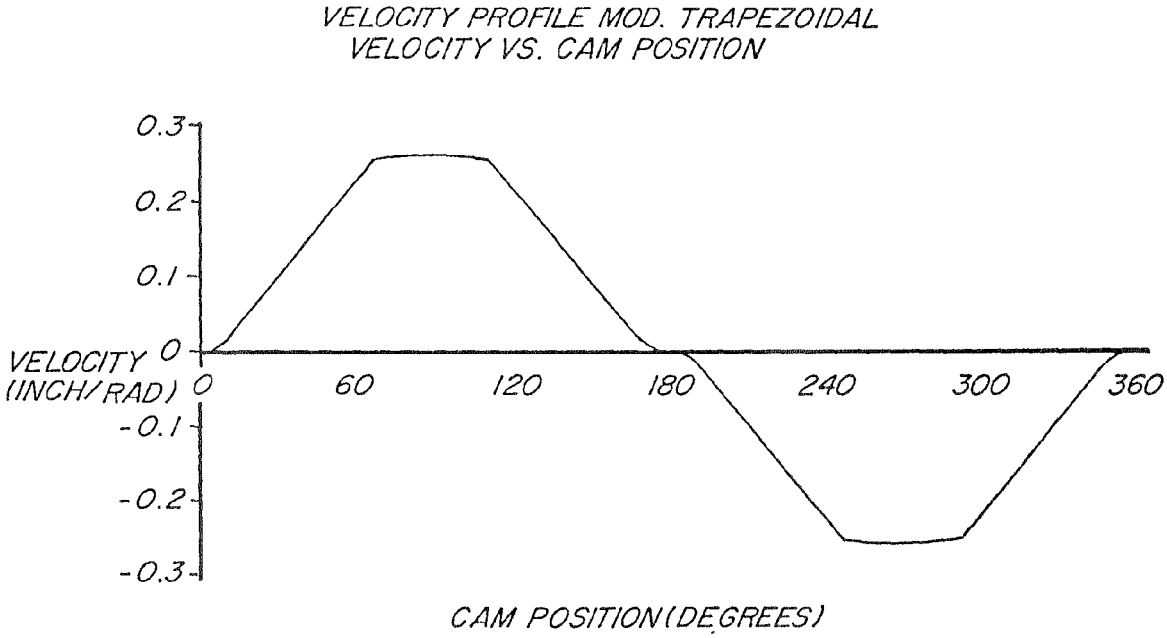
FIG. 12 is a simplified graphical representation of a velocity profile for a modified trapezoidal cam profile.
Figure 13:
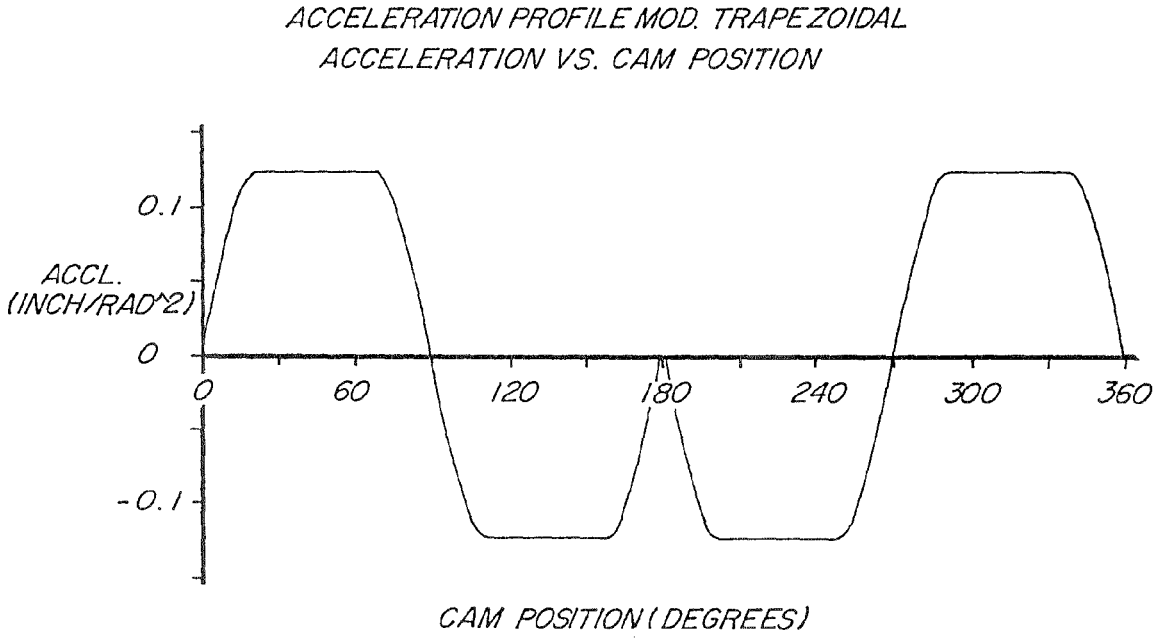
FIG. 13 is a simplified graphical representation of an acceleration profile for a to modified trapezoidal cam profile.
Figure 14:
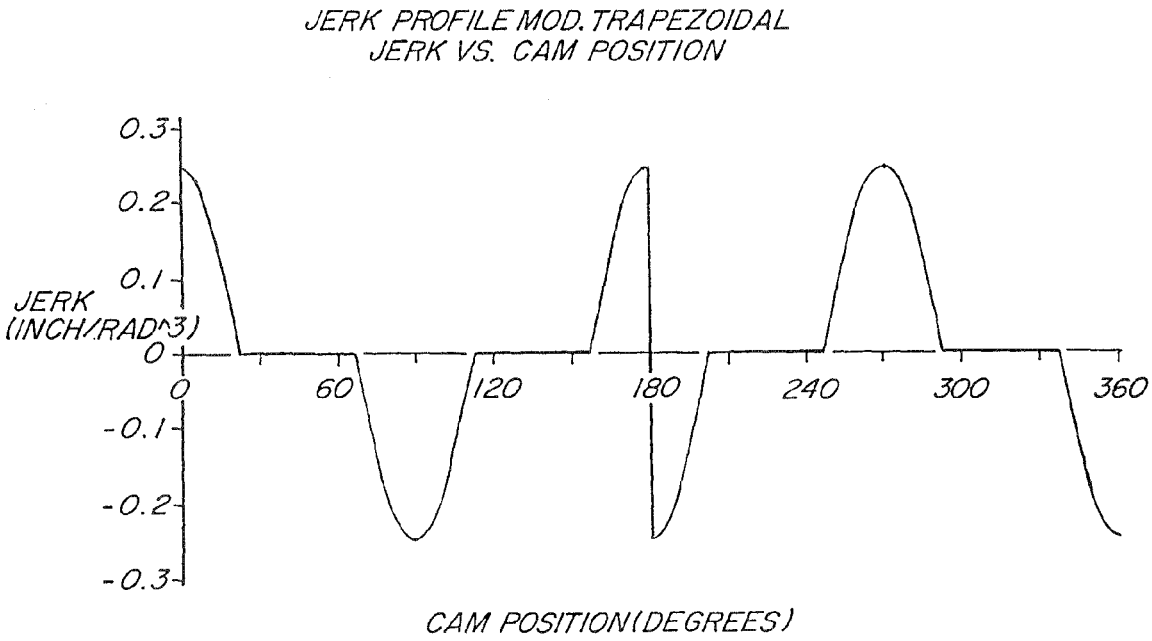
FIG. 14 is a simplified graphical representation of a jerk profile for a modified trapezoidal cam profile.
Figure 15:
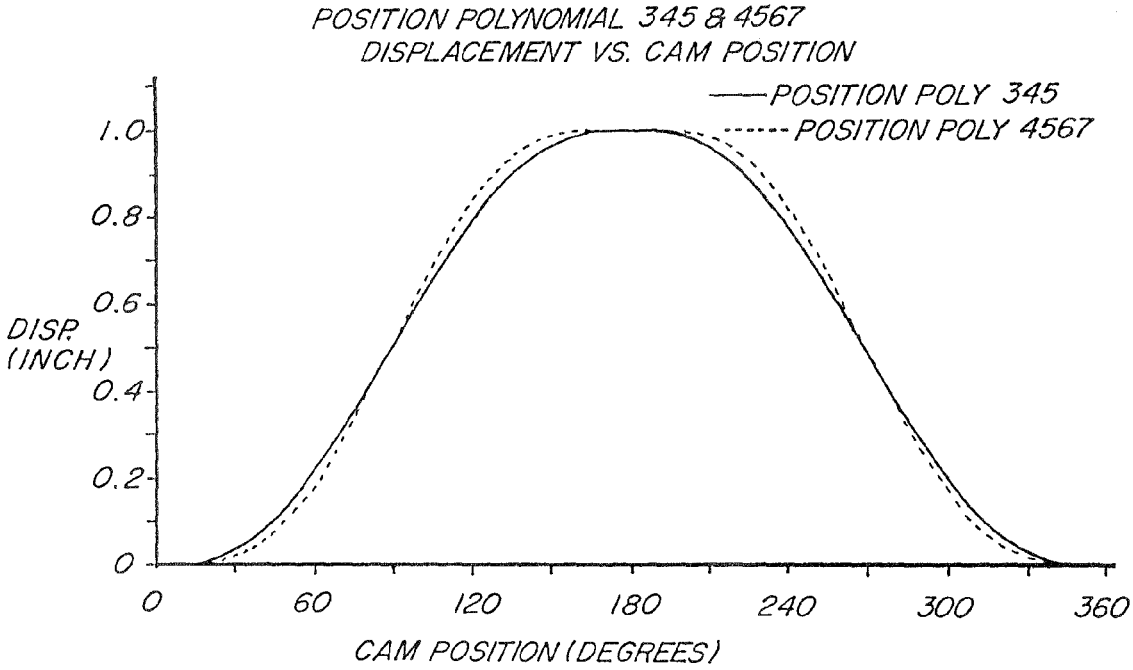
FIG. 15 is a simplified graphical representation of position profiles for 345 and 4567 polynomial cam profiles.
Figure 16:
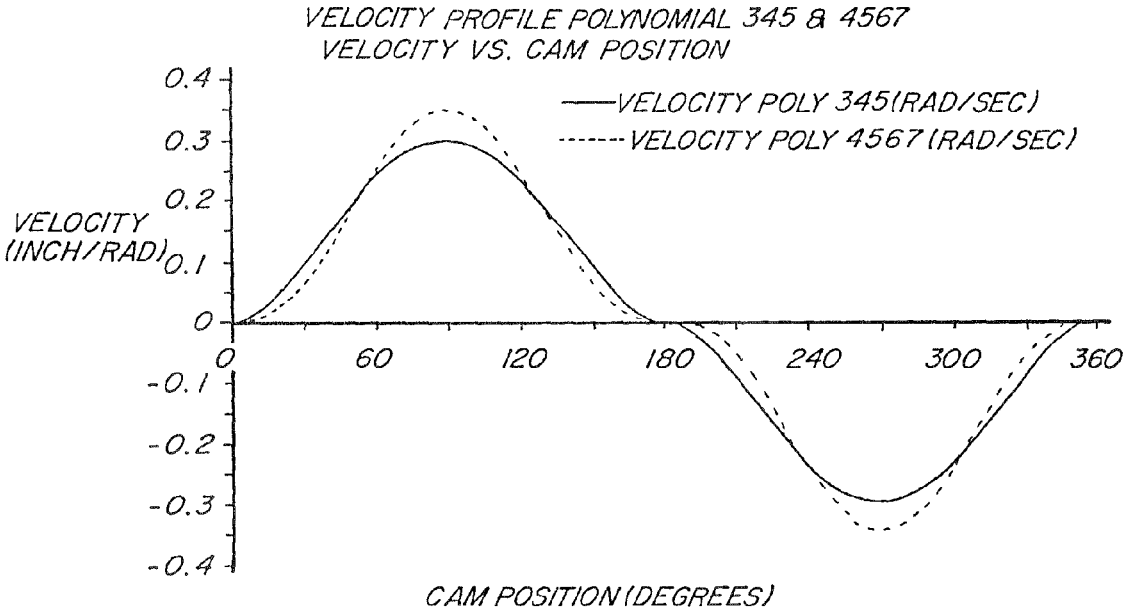
FIG. 16 is a simplified graphical representation of velocity profiles for 345 and 4567 polynomial cam profiles.
Figure 17:
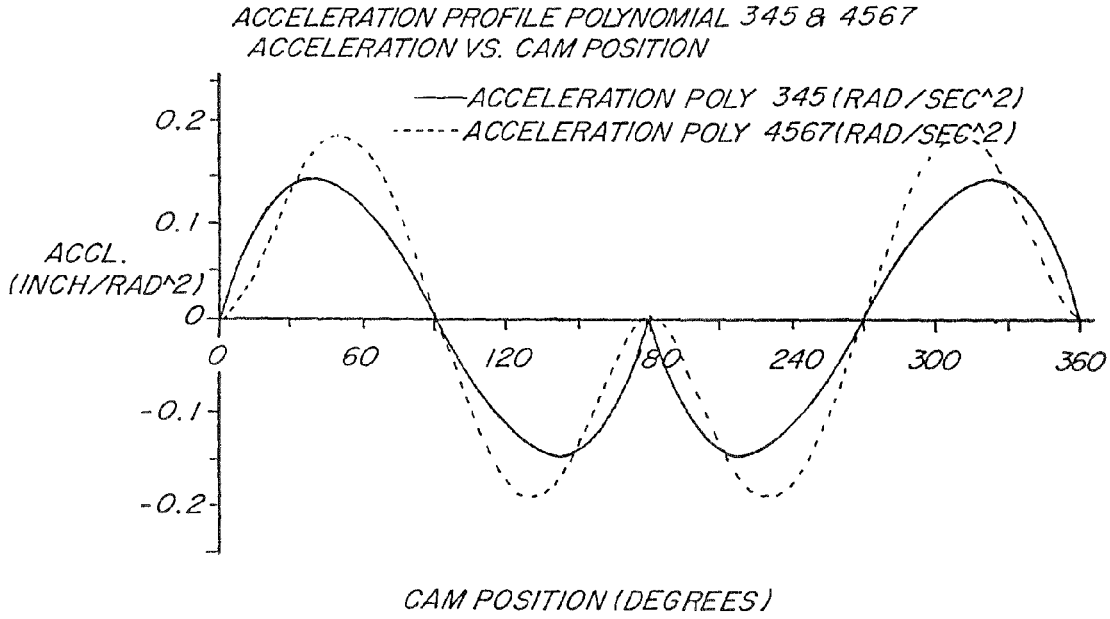
FIG. 17 is a simplified graphical representation of acceleration profiles for 345 and 4567 polynomial cam profiles.
Figure 18:
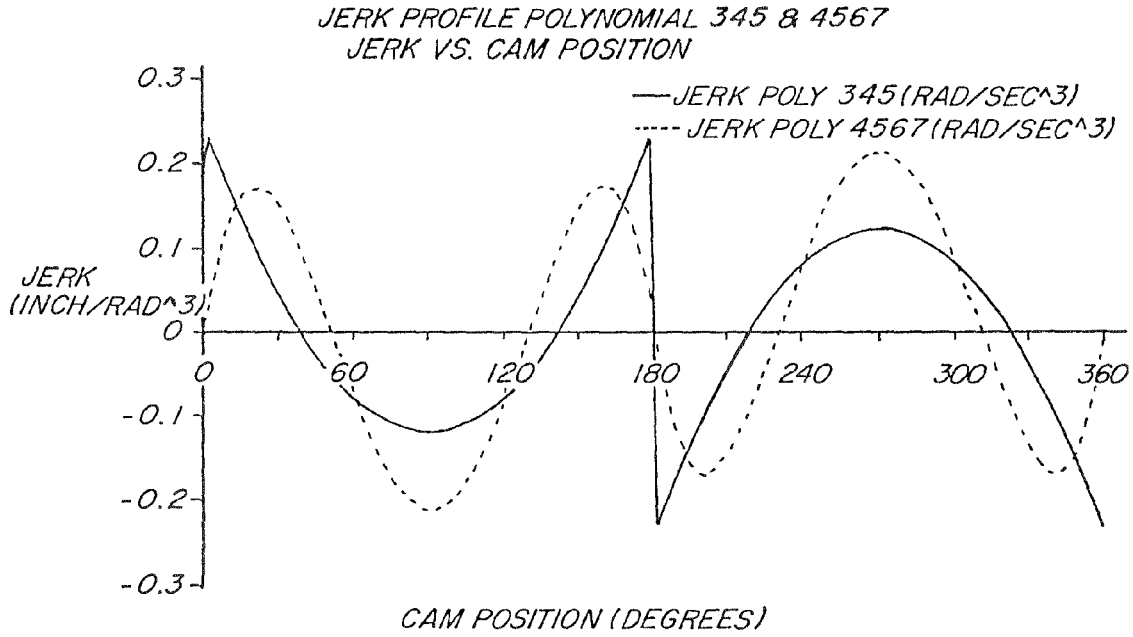
FIG. 18 is a simplified graphical representation of jerk profiles for 345 and 4567 polynomial cam profiles.
Figure 19:
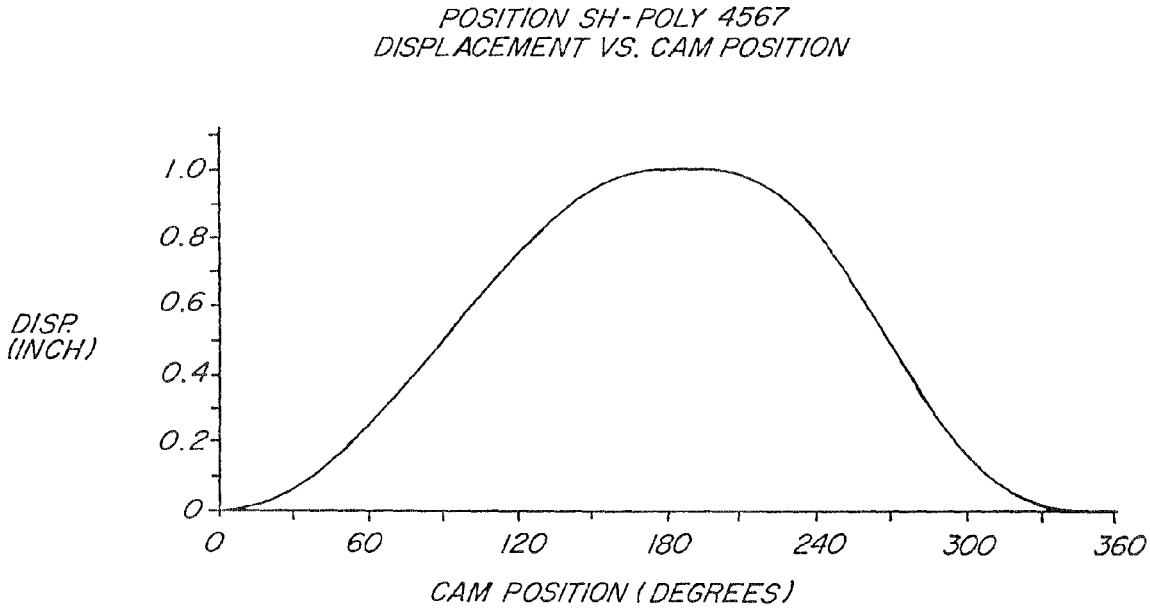
FIG. 19 is a simplified graphical representation of a position profile for mixed simple harmonic and 4567 polynomial cam profiles.
Figure 20:
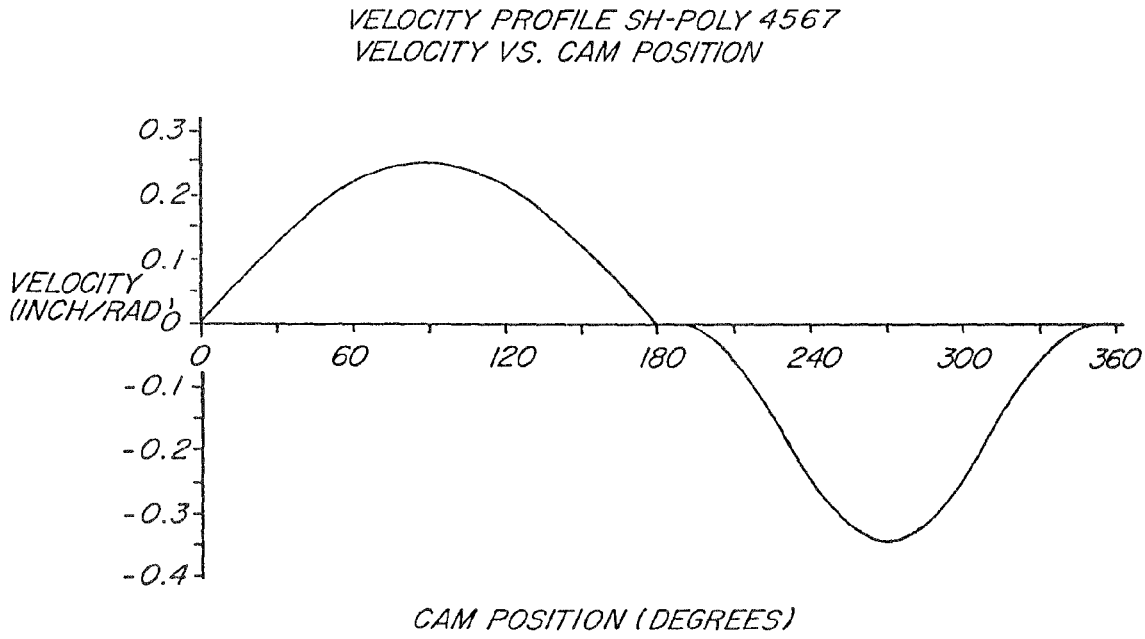
FIG. 20 is a simplified graphical representation of a velocity profile for mixed simple harmonic and 4567 polynomial cam profiles.
Figure 21:
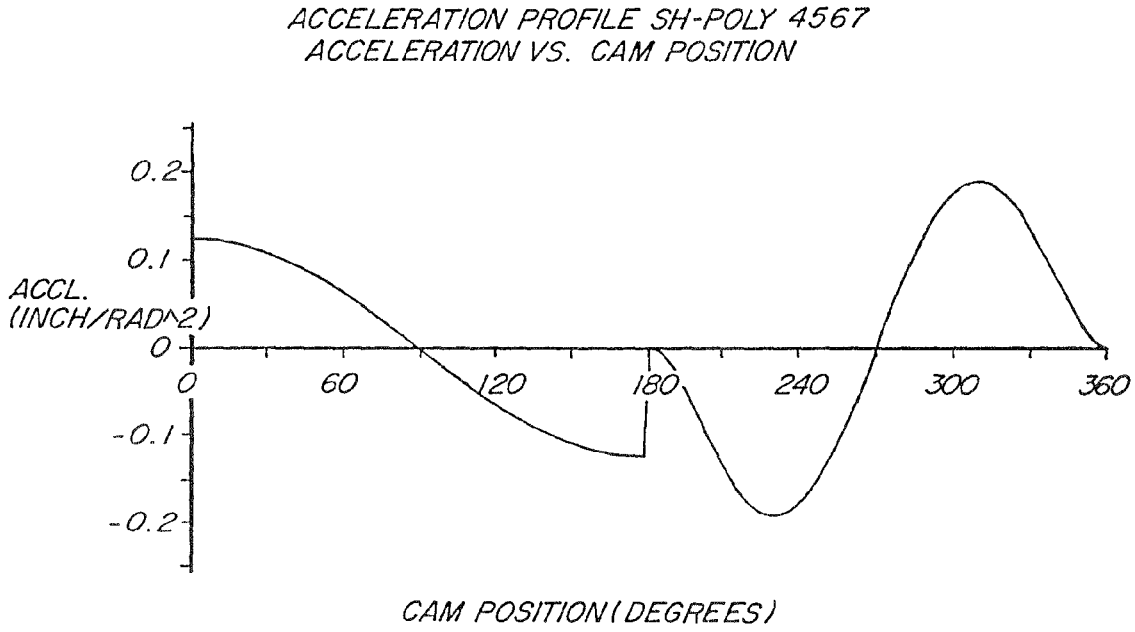
FIG. 21 is a simplified graphical representation of an acceleration profile for mixed simple harmonic and 4567 polynomial cam profiles.
Figure 22:
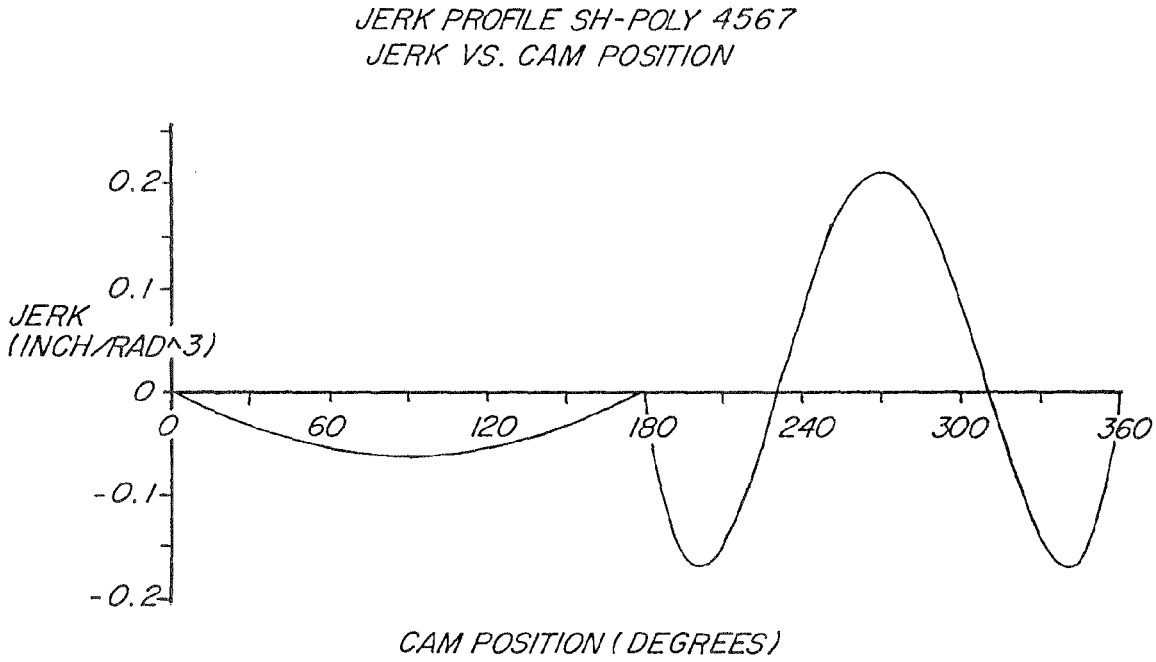
FIG. 22 is a simplified graphical representation of a jerk profile for mixed simple harmonic and 4567 polynomial cam profiles.

Referring now more particularly to the drawings, aspects of preferred to embodiments of the invention will be discussed in greater detail. According to the present invention, there are an unlimited number of cam profiles to be used as operating profiles for control of a honing stroke. For example the following cam profiles will be compared: Simplified Harmonic, Cycloidal, Modified Sine, Modified Trapezoidal, Polynomial 345 and Polynomial 4567. Referring to FIGS. 3, 4, 5 and 6, profiles of displacement, velocity, acceleration and jerk verses cam position for the Simple Harmonic cam profile already used as a motion profile in Sunnen's linkage driven honing machines, are shown. As shown in FIGS. 4, 5 and 6, the Simple Harmonic profile produces minimum acceleration with smooth velocity, acceleration and jerk profiles. Therefore it is recommended for small stroke settings where the reciprocation cycles per minute will be high. Given the smooth jerk profile, the vibrations produced by the motion are very small. In short cyclic motion, this profile offers the most controllable outputs. The inertia input will be consistent for horizontal applications.

Referring also to FIGS. 7, 8, 9 and 10, profiles of displacement, velocity, acceleration and jerk verses cam position for Modified Sine and Cycloidal cam profiles are shown. These profiles have very smooth velocity profiles. The acceleration and jerk profiles are consistent and their peaks are small in magnitude. They offer a very good compromise to replace the Simple Harmonic profile.

Referring also to FIGS. 11, 12, 13 and 14, profiles of displacement, velocity, acceleration and jerk for a Modified Trapezoidal cam profile are shown. Here it should be noted that the Modified Trapezoidal profile has a limited range in the acceleration and jerk. The benefits of this profile are related to hard parametric limits (maximum velocity and acceleration are set by the mechanical system, maximum output constraints by mechanical limits). The control scheme is simplified given the only possible variable is the stroke length. The possible rate will be determined by the hard limits of speed and acceleration. It also offers a fast control scheme by reducing the variable set.

Referring also to FIGS. 15, 16, 17 and 18, profiles of displacement, velocity, acceleration and jerk for two representative polynomial cam profiles which are a 345 polynomial profile and a 4567 polynomial profile, are shown. Here, it can be noted that the benefit of the polynomial profile is that it can be controlled with the boundaries conditions (initial and final conditions, initial acceleration=0, final acceleration=0 . . . ). This system is well suited to optimize relational constraints such as tool performance under specific velocity, or acceleration limits. An example of this is the matching of the acceleration profiles for a vertical application, where the influence of gravity can be significant. In cases were tandem bores are being honed, the profile can be modified to optimize material removal to in the bore hone areas at the same time that cycle time be reduced.

Referring also to FIGS. 19, 20, 21 and 22, samples curves representative of mixed cam profiles that can be used to improve performance of tool or machine components are shown. Here, the mix is a simple harmonic profile and a 4567 polynomial profile. As an example application, this mixed profile can be used for a honing tool with a very large ratio between bore diameter and tool length which will be weak under compression loads. Therefore the output will be limited by the maximum buckling loads added to the shear limits.

The present Servo Stroking System is based on the optimization of the stroking process in honing, using the already existing machine tool components. These tools are the following: Servo Control, Digital Control and linear motion system (ball screw, roller screw, linear servomotor, rack and pinion, hydraulic cylinder, chain, belt). The optimization is related to three main groups: honing output (surface finish, bore geometry, part cycle), honing tool (tool geometry, work loads), honing machine components (work loads, life cycles).

Figure 23:
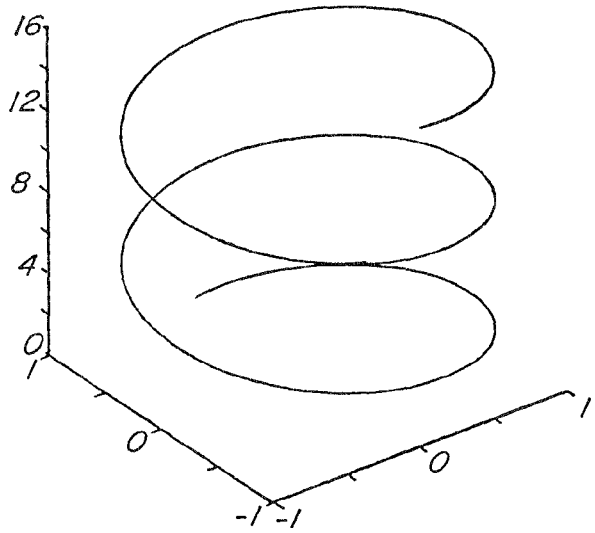
FIG. 23 is a simplified three-dimensional graphical representation of a path of an abrasive grain as a result of stroking and rotation during a honing operation.

The total throughput in a honing machine is controlled by the following elements:

Stroker (stroker rate, motion profile)
Spindle rate (RPM)
Feed Rate (tool expansion rate, force expansion rate)
Coolant selection
Abrasive selection These elements are integrally related to the honing process and desired outcome. The optimum performance of the process is not established and will be different for every specific part to be honed. The system variables are sub grouped into machine control components: stroker, spindle and feed system and tool components: coolant and abrasives. This subdivision establishes a system dependency, relating the tool variables as constraints (defining abrasives and coolant as honing part delimiters, related to surface finish and material removal interactions). These relations only offer the motion control components as possible optimization parameters. For many applications, the main point of optimization is the minimization of the abrasive use with respect to the maximum material removal, producing a minimum production cycle time. This process is independent of the crosshatch angle. The desired cross hatch angle is related to the final section of the honing process. The physical displacement of an abrasive grain throughout the bore produces a helix, as shown in FIG. 23.

Figure 24:
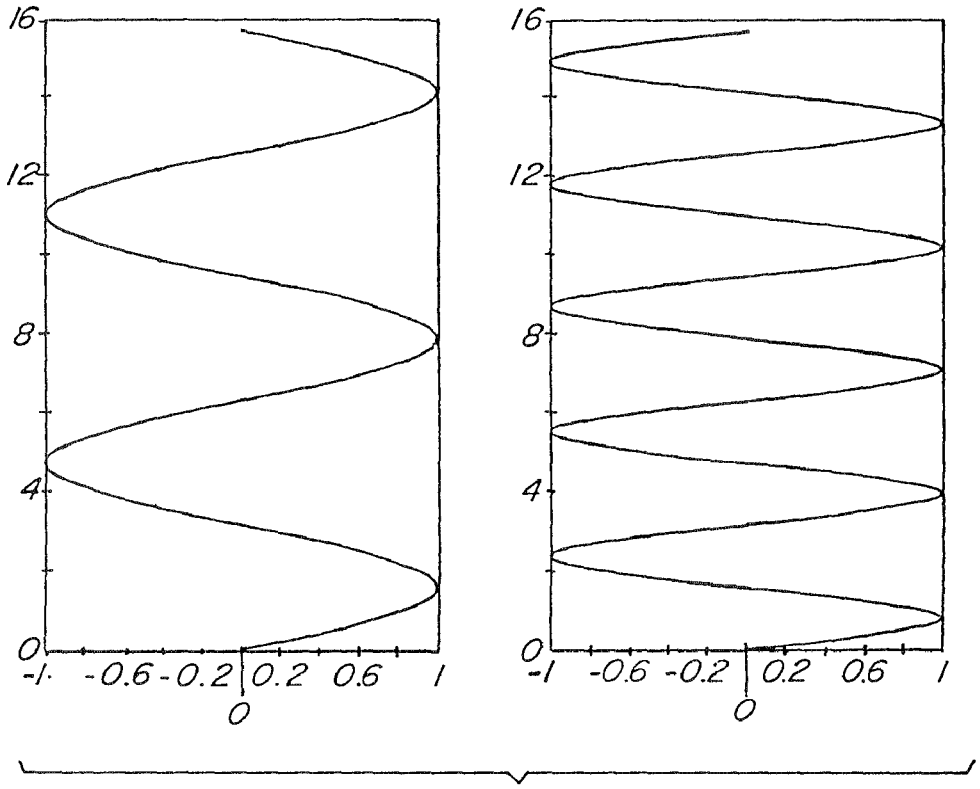
FIG. 24 is a pair of two-dimensional graphical representations of helical grain paths for different stroker rates.

FIG. 24 shows two dimensional representations of a helix to illustrate the difference in grain path produce by varying stroker rate and keeping the spindle rate constant. The left hand representation is of a faster stroker rate. The right hand representation is of a slower stroker rate.

Here, it should be noted the rotation of a honing tool can also be controlled so as to also follow any cam profile, such as any of those listed above, namely, a simplified harmonic, modified sine, trapezoidal, polynomial, and/or mixed cam profile. And, the cam profile or profiles of the rotation can be coordinated with that of the stroking motion of the tool, for instance to produce a desired cross hatching pattern. In this regard, utilizing the same cam profile for both stroking and rotation of a tool, timed to coincide, has been found to produce a cross hatching pattern which is more uniform along the length of a honed surface.

Figure 25:
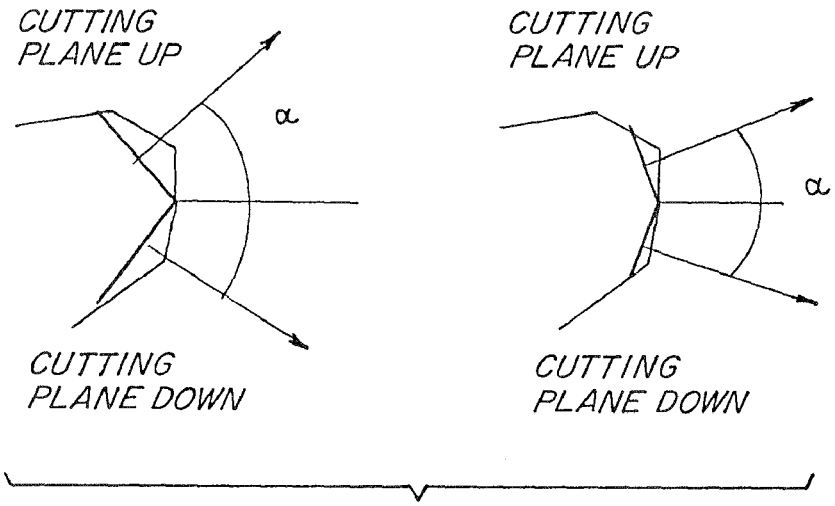
FIG. 25 is a pair of simplified schematic representations of an abrasive grain, illustrating effects of different grain path angles.

Referring to FIG. 25, two illustrations of a representative abrasive grain are shown. Arrows are shown superimposed on each of the representations to represent the grain path for upward and downward stroking motions, respectively. The grain paths are normal to cutting planes on the grain for the upward and downward stroking motions. These planes are depending of the stroking direction. Therefore there will be two cutting planes for the same abrasive grain. The total length of the cutting edge in a two dimensional representation is directly proportional to the path angle between the two stroking directions, represented by the symbol $\alpha$.

The most significant benefit that is observed of a greater path angle $\alpha$ is the increased surface in the cutting plane of the abrasive grain. Therefore a more aggressive feed force is admissible given the homogeneous distribution along the grain surface. The results are shorter cycles and improved abrasive efficiency or performance. If the feed force is kept constant, the increase in the stroke rate will modify the cutting plane orientation until an optimum angle $\alpha$ is found on the abrasive grain. This angle will produce the best result when the grain is self sharpening by the honing process.

Figure 26:
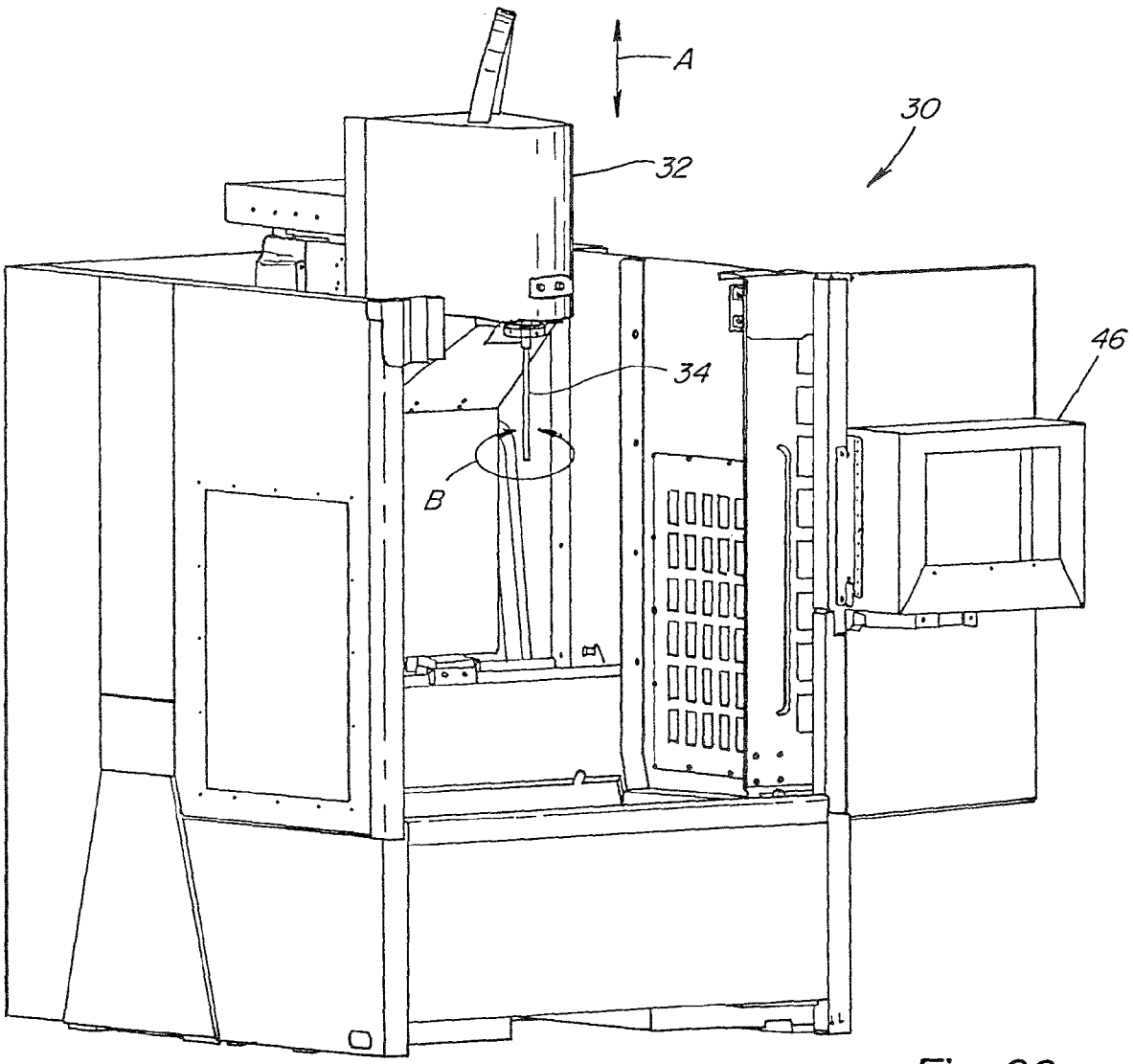
FIG. 26 is a simplified perspective view of a honing machine according to the invention.

In FIG. 26, a honing machine 30 is shown including aspects of a servo stroking apparatus and system according to the present invention. Honing machine 30 generally includes a spindle carriage 32 which is movable in a reciprocating stroking action, denoted by arrow A, according to the present invention by a linear motion servo stroking apparatus such as the ball screw, roller screw, linear servomotor, rack and pinion, hydraulic cylinder, chain, or belt mentioned above. Here, carriage 32 is shown supported for reciprocal stroking action in a vertical direction, but it should be understood that stroking in other directions is to also contemplated under the present invention. Spindle carriage 32 includes a honing tool 34, which can be of conventional or new construction and operation, generally including an elongate mandrel carrying one or more honing elements, e.g., abrasive stones or sticks or sleeve which can be moved radially or laterally outwardly and inwardly relative to the mandrel, and which abrade and hone a surface of a work piece in which tool 34 is inserted, as tool 34 is rotated, as denoted by arrow B, in the well known manner. In a typical application, as spindle carriage 32 is reciprocally stroked upwardly and downwardly, as denoted by arrow A, honing tool 34 will rotate in one direction or the other, as denoted by arrow B, within a hole or bore in a work piece, for providing a desired surface finish and shape to one or more surfaces defining the bore or hole or a portion thereof.

Figure 27:
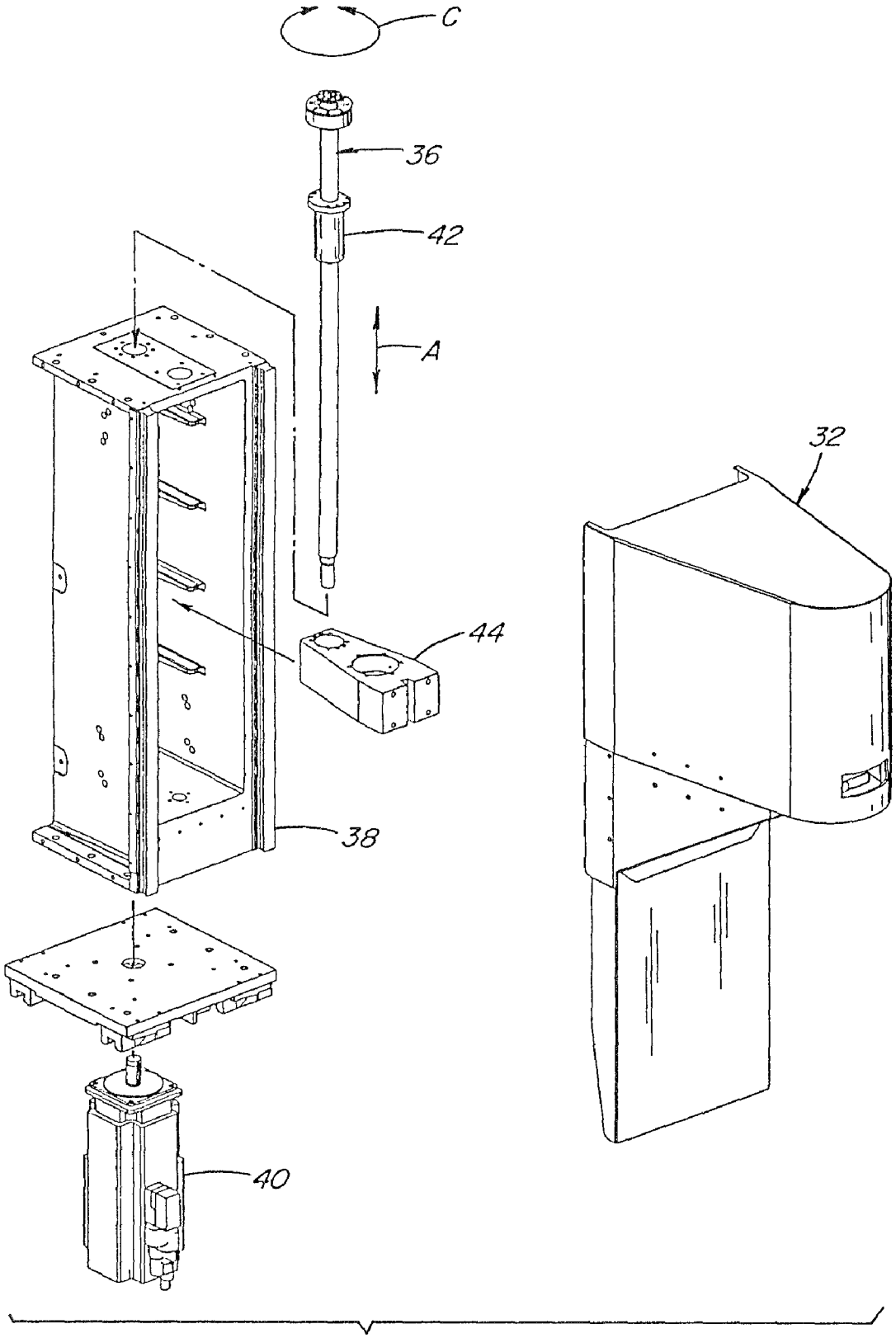
FIG. 27 is a simplified exploded representation of stroking apparatus of the machine of FIG. 26.

FIG. 27 shows a preferred servo controlled stroking apparatus for spindle carriage 32 of honing machine 30, including a preferred servo controlled linear motion system or drive mechanism therefor, which includes a ball screw 36 which is supported in a ball screw housing 38 for rotation, as denoted by arrow C. Ball screw 36 is precisely rotatable according to the teachings of the present invention, by a servo motor 40, the number of rotations of and the rotational position of which, and thus the axial position of carriage 32, being precisely detectable by an encoder or other sensor or feedback device of the apparatus in the well known manner. A ball nut 42 is moved longitudinally along ball screw 36 by the rotation thereof, as denoted by arrow A, and from the rotation count of ball screw 36 the longitudinal position of ball nut 42 is determined. A spindle support 44 is mountable to ball nut 42 and supports spindle carriage 32 for movement with nut 42 in direction A for producing the stroking action in an axial direction parallel to ball screw 36 according to the invention.

Referring again to FIG. 26, servo motor 40 is controllable by a processor based controller 46 configured and operable for receiving the information representative of the axial location of spindle carriage 32 and thus honing tool 34 and the honing elements thereof, and controllably stroking them in accordance with any of the curves shown in FIGS. 3-22 herein.

Figure 28:
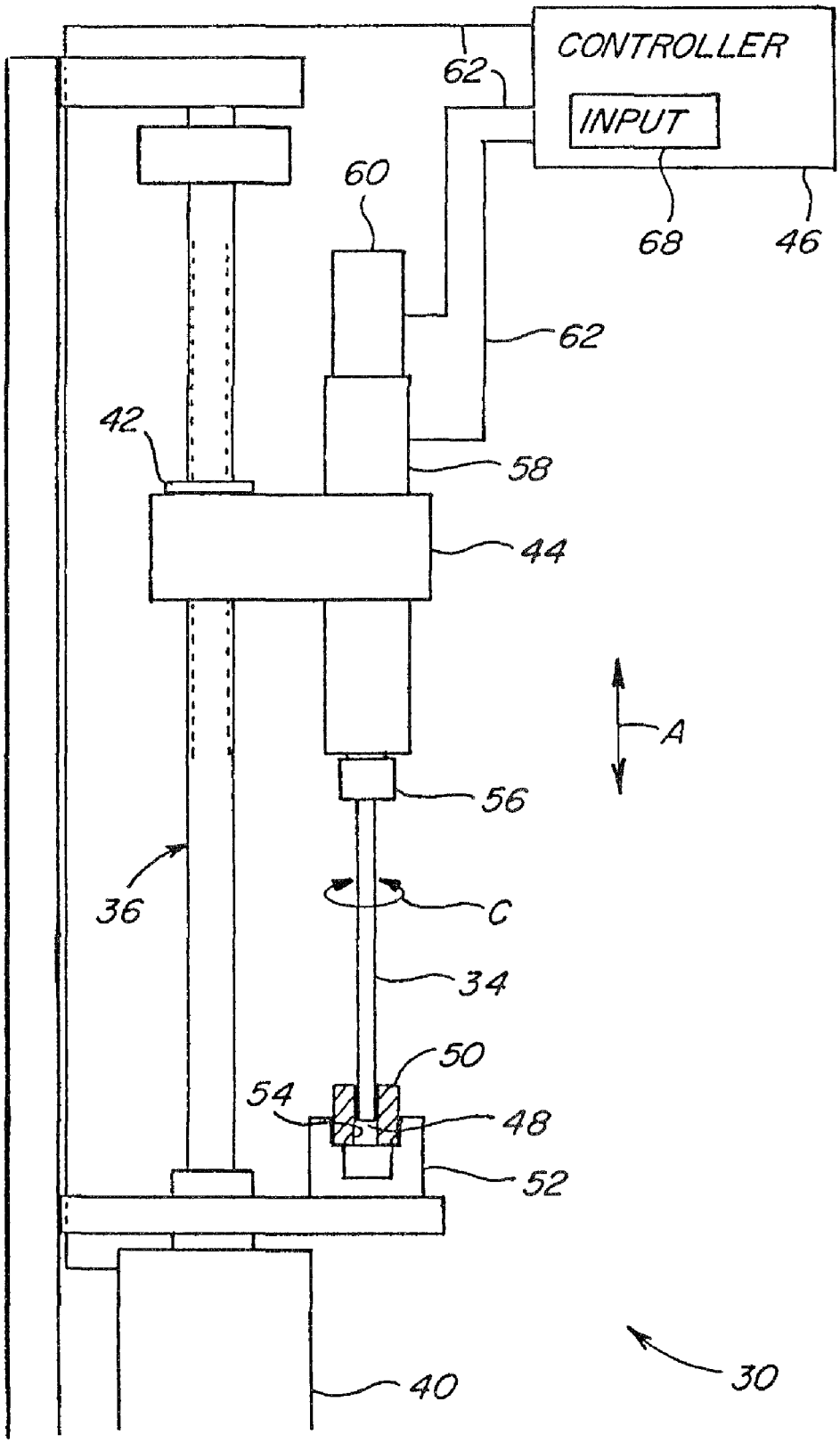
FIG. 28 is a simplified schematic side view of the stroking apparatus of the honing machine of FIG. 26.

Referring also to FIG. 28, a simplified schematic representation of the stroking apparatus of honing machine 30 is shown. Here, tool 34 is shown inserted into a bore 48 of a work piece 50 held in a fixture 52 of machine 30, to bring the honing elements into contact with an internal surface 54 of work piece 50 defining bore 48 for honing the surface. Honing tool 34 is supported by a rotatable spindle 56 for the reciprocal movement in the axial direction denoted by arrow A, and rotation denoted by arrow C, for effecting desired honing to of surface 54 of work piece 50. Spindle 56 is rotatably driven by a spindle drive 58 connected to and controlled by controller 46, and is configured to provide feedback to controller 46, namely, information representative of rotational position, e.g., using an encoder, resolver, etc, in the well known manner, such that rotational speed, and resistance to rotation, e.g., via measure of electrical current or energy levels consumed at a particular speed, can be determined and utilized according to the invention. As a result, any acceleration and/or deceleration of rotation can be determined, e.g., as a second derivative of the rotational displacement, and those and the other parameters can be used by controller 46 for controlling acceleration and deceleration of the spindle, as well as other operating parameters for imparting a special shape to a surface being honed, as will be explained. Honing tool 34 is radially expanded and retracted by a feed drive 60 connected to and controlled by controller 46 to effect lateral movement of a honing element or elements of the tool relative to the axial direction of the stroking movement, and drive 60 is configured and operable for providing information representative of the lateral or feed position of the honing element or elements to controller 46, also in the well known manner. Spindle 56 supporting tool 34, as well as drives 58 and 60, are supported on spindle support 44 connected to ball nut 42, so as to be movable longitudinally along ball screw 36 in the axial direction as effected by rotation of servo motor 40 in connection therewith.

As noted previously, an encoder or other device of the servo controlled stroking apparatus is utilized for counting rotations of ball screw 36 for determining a longitudinal position of ball nut 42 therealong and thus the longitudinal position of honing tool 34 in a work piece such as work piece 50. From this information that the longitudinal position of tool 34 is determined, and with information relating to the timing of changes in the longitudinal position, velocity, acceleration, and jerk of ball nut 42 and tool 34 can be precisely controlled so as to follow a desired cam profile, such as any of those illustrated in the figures just discussed, as precisely controlled by controller 46. Here, controller 46 is shown connected by conductive paths 62 to servo motor 40 and also drives 58 and 60, for controlling the linear position, velocity, acceleration and jerk profiles of tool 34, and also the direction and speed of rotation of tool 34 through drive 58, as well as the lateral or radial expansion (feed) and contraction thereof as effected through drive 60, and for receiving the information representative of stroke or axial position, feed position, and resistance to rotation.

Figure 29:
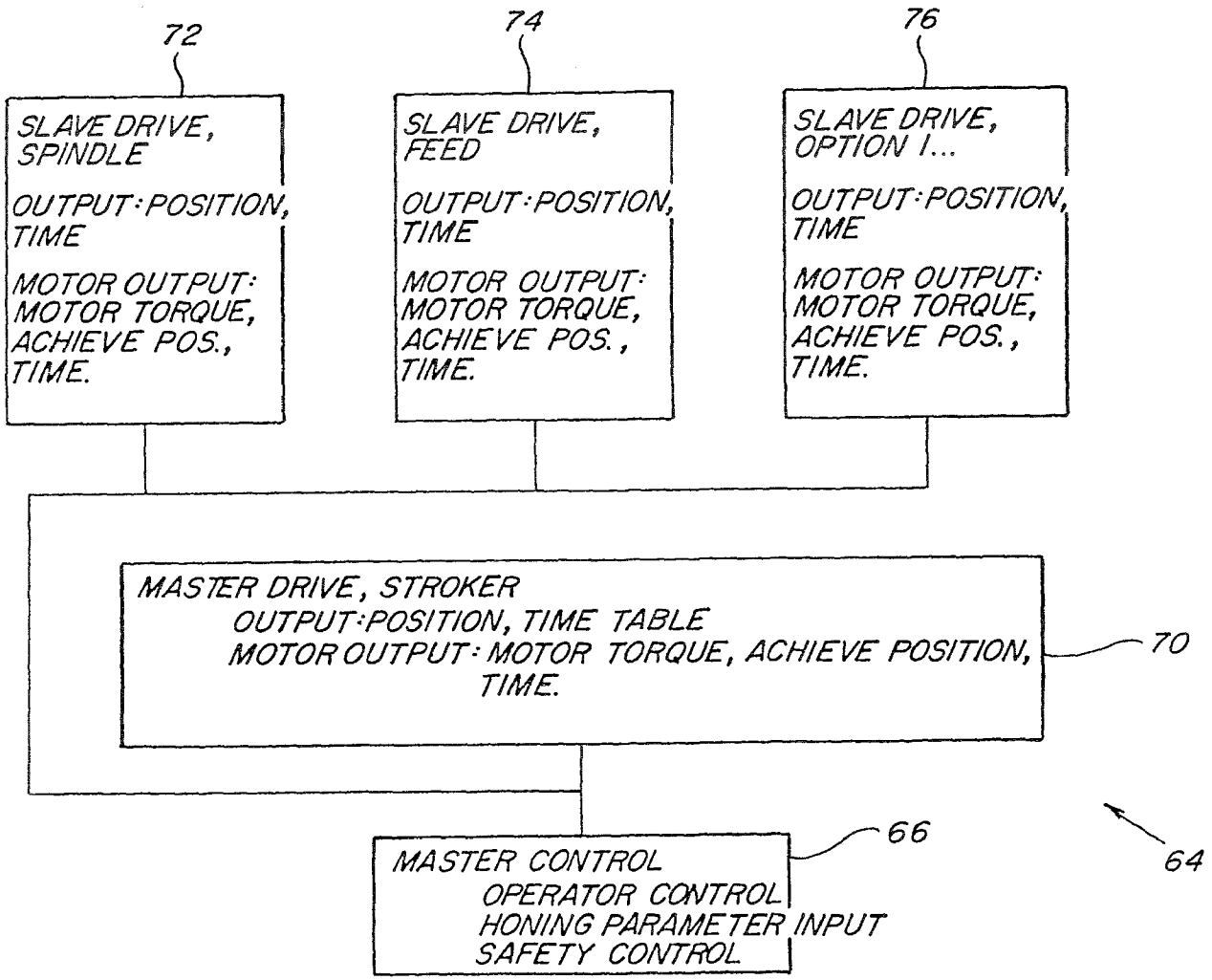
FIG. 29 is a simplified diagrammatic representation of elements of the honing machine of FIG. 26.

Referring also to FIG. 29, a diagrammatic representation 64 of a scheme for controlling operation of honing machine 30 is shown. In diagram 64, block 66 represents to functions of controller 46 including operator control, and honing parameter input, as effected by inputs or commands received through an input device 68 of controller 46, which can be a touch screen and/or a keyboard, and/or any other common commercially available operator controllable input devices. Functions of servo motor 40 are represented by block 70 and include position outputs for controlling and determining position, velocity, acceleration and jerk of honing tool 34 in the above described manner. Block 72 represents functions of spindle drive 58, including position and time outputs, and motor outputs including motor torque, achieve position, and time, in relation to operational parameters of spindle 56. Block 74 illustrates functions in relation to drive 60 for effecting expansion and contraction or feed of the honing elements of tool 34 as effected by drive 60, including position and time outputs, and motor outputs including motor torque, achieve position, and time. Block 76 represents functions of one or more optional drives of machine 30.

Figure 30:
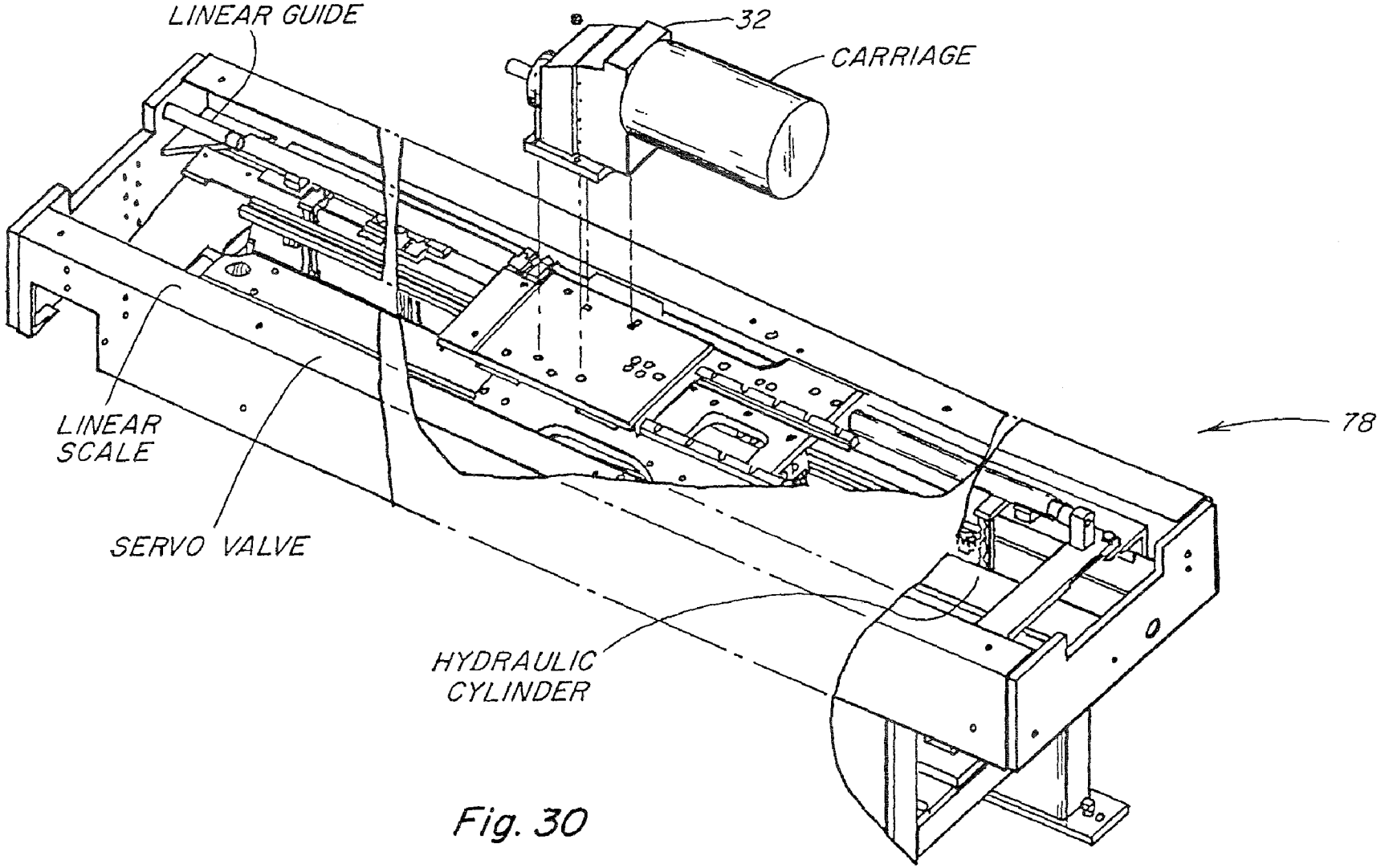
FIG. 30 is a simplified perspective view of alternative stroking apparatus for a to honing machine according to the invention, the apparatus including a servo controlled fluid cylinder.

Referring also to FIG. 30, alternative servo controlled stroking apparatus 78 for the spindle carriage 32 of a honing machine, such as honing machine 30, is shown. Apparatus 78 includes a servo stroking drive comprising a linear motion system which utilizes a hydraulic cylinder as the linear motion driver for carriage 32, as controlled by a servo valve. Longitudinal position of carriage 32 is determined by a linear scale or encoder and the linear motion is controlled by a linear guide.

Figure 31:
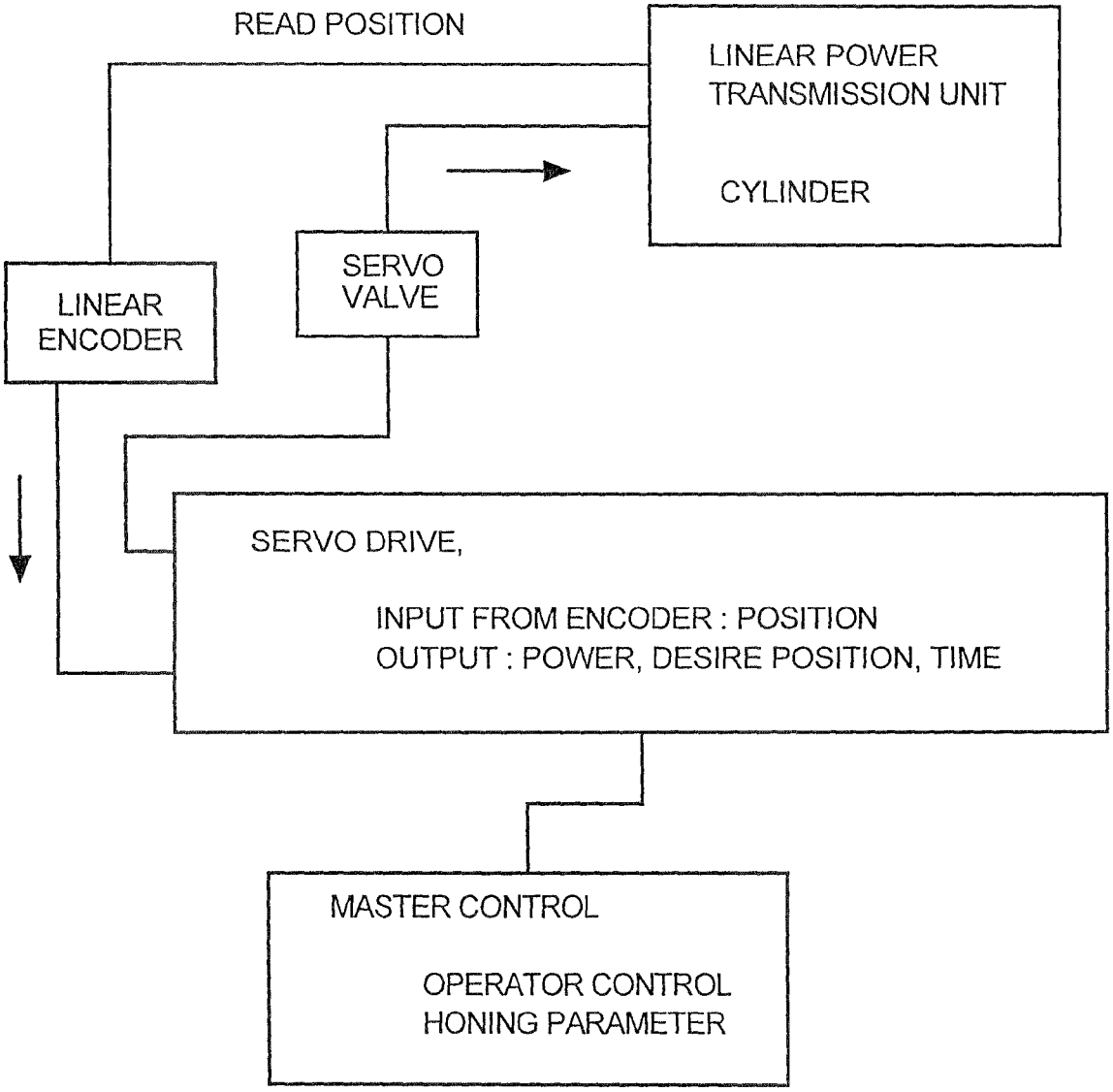
FIG. 31 is a simplified diagrammatic representation of elements for controlling the apparatus of FIG. 30.

Referring also to FIG. 31, a diagrammatic representation of elements of a servo control scheme for apparatus 78 is shown. Essentially, honing parameters are inputted, for instance, utilizing a controller such as controller 46 of machine 30, as above, to effect operation of a servo stroker drive which controls the servo valve to effect transfer of fluid to the cylinder for causing linear extension and retraction movements thereof. Feedback of the position is provided by a linear encoder which inputs positional data to the servo stroker drive for use in controlling the servo valve. The apparatus of FIG. 30 and control scheme of FIG. 31 can be utilized for effecting stroking motions having cam profiles and velocity, acceleration and jerk profiles as illustrated and discussed above.

Figure 32:
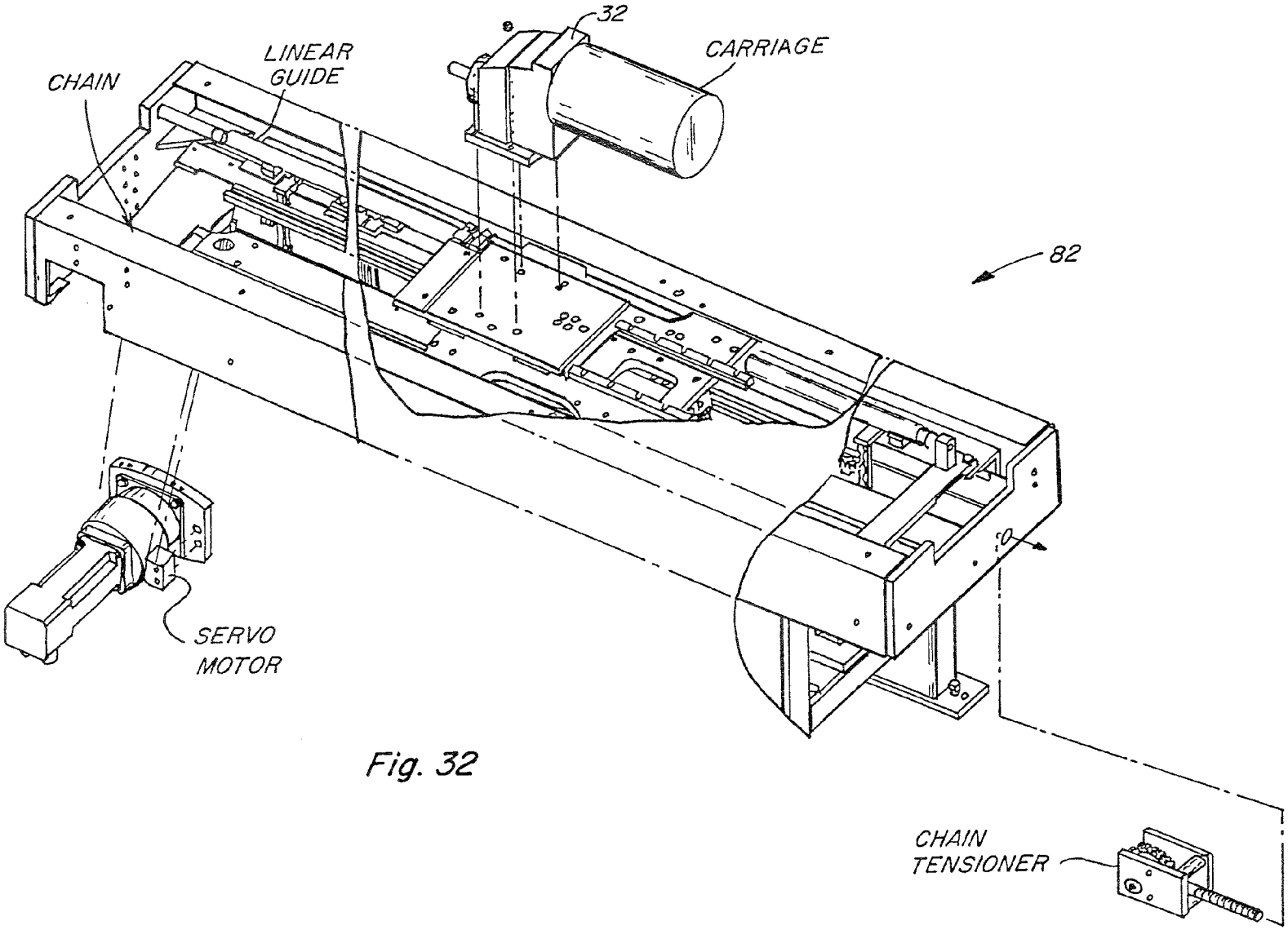
FIG. 32 is a simplified perspective representation of another alternative stroking apparatus for a honing machine according to the invention, the apparatus including a servo controlled chain drive.

Referring also to FIG. 32, another alternative servo stroking apparatus 82 for spindle carriage 32 of a honing machine, such as honing machine 30, is shown. Apparatus 82 is illustrative of a servo controlled chain drive in connection between a servo motor and carriage 32 for effecting linear movements of carriage 32 as guided by a linear guide.

Figure 33:
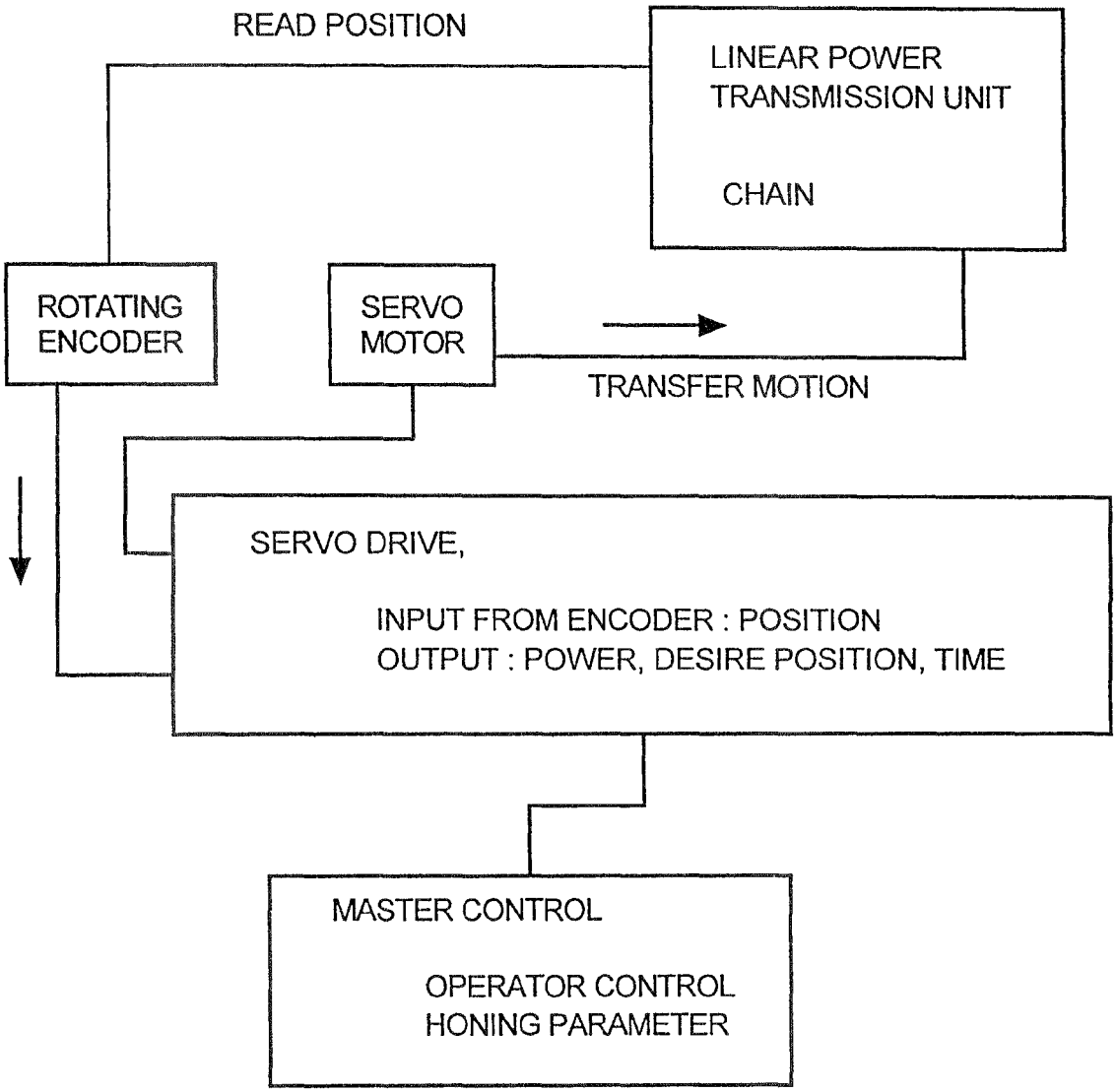
FIG. 33 is a simplified diagrammatic representation of elements of a control for the apparatus of FIG. 32.

FIG. 33 is a diagrammatic representation of elements of a control scheme for stroking apparatus 82, as controlled by a controller, such as controller 46 of honing machine 30. Essentially, a servo drive receives inputs from an encoder of the position of carriage 32 to and outputs power and desired position and time parameters to the servo motor which transfers motion to the chain, thereby rotating the encoder which outputs the signals represented of the carriage position. Again, servo controlled stroking apparatus 82 can be operated to effect stroking actions of carriage 32 having any of the cam profiles discussed above.

Figure 34:
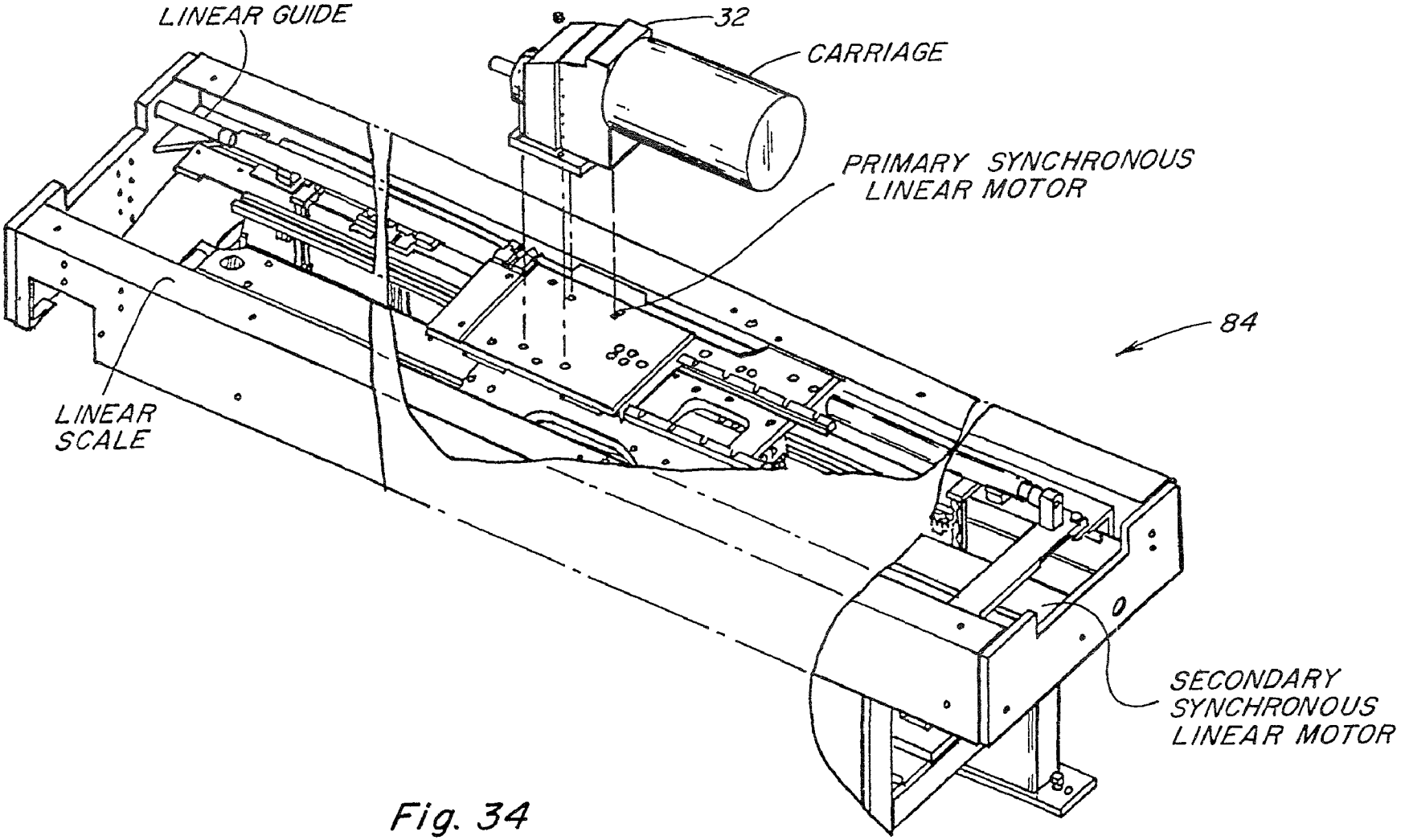
FIG. 34 is a simplified perspective representation of still another alternative stroking apparatus for a honing machine according to the invention, the apparatus including a servo controlled linear motor.

Referring also to FIG. 34, still another alternative servo controlled stroking apparatus 84 for spindle carriage 32 of a honing machine such as honing machine 30, is shown. Apparatus 84 includes a linear motion system including a synchronous linear motor in connection with carriage 32, for effecting controlled linear motion thereof.

Figure 35:
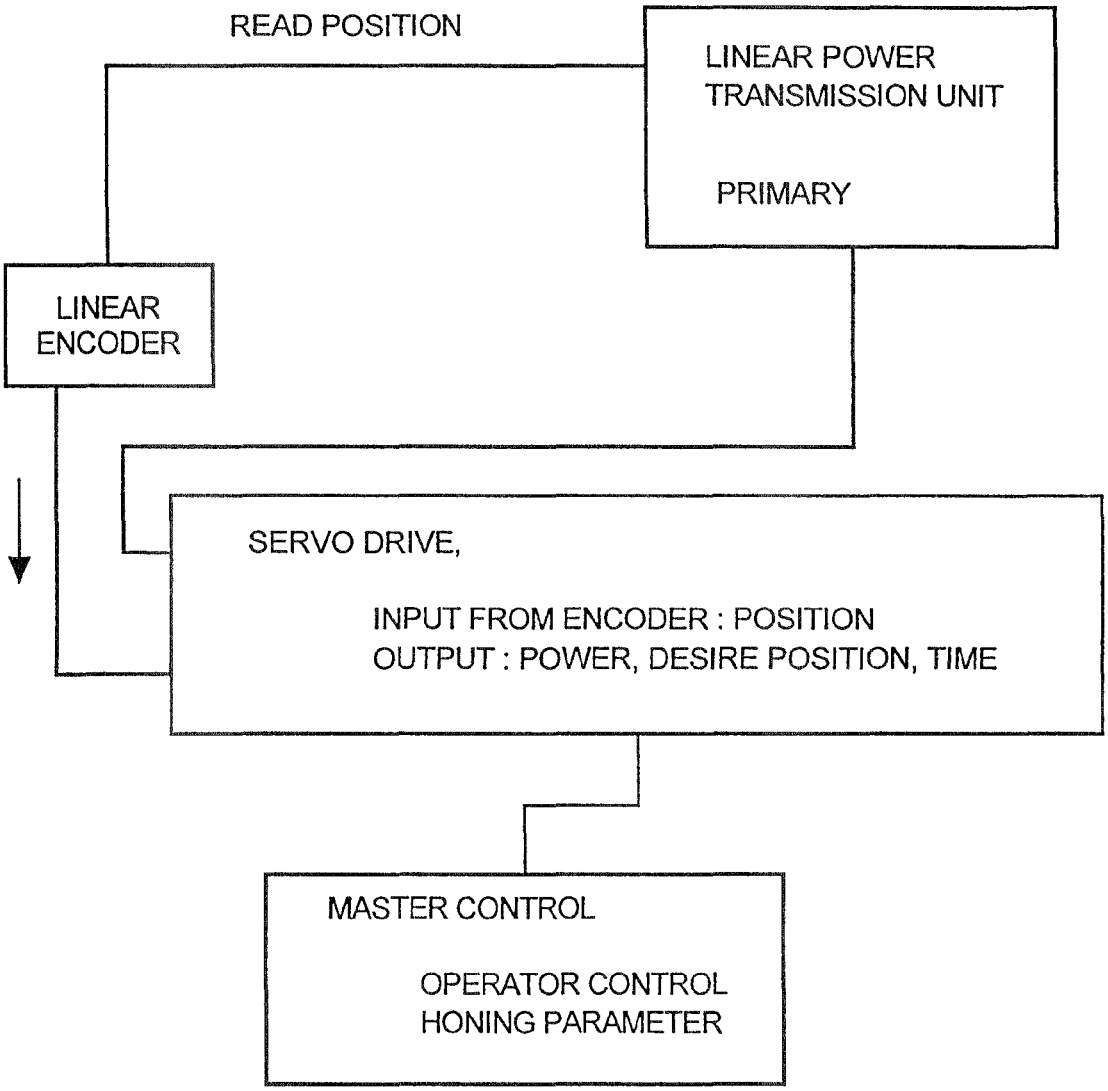
FIG. 35 is a simplified diagrammatic representation of elements for controlling the apparatus of FIG. 34.

FIG. 35 is a diagrammatic representation of elements of a control scheme for stroking apparatus 84, as controlled by a controller, such as controller 46 of honing machine 30. Again, essentially, a servo drive receives inputs from an encoder of the position of carriage 32 and outputs power and desired position and time parameters to the linear motor to effect changes in the carriage position. Again also, servo controlled stroking apparatus 84 can be operated to effect stroking actions of carriage 32 having any of the cam profiles discussed above.

Figure 36:
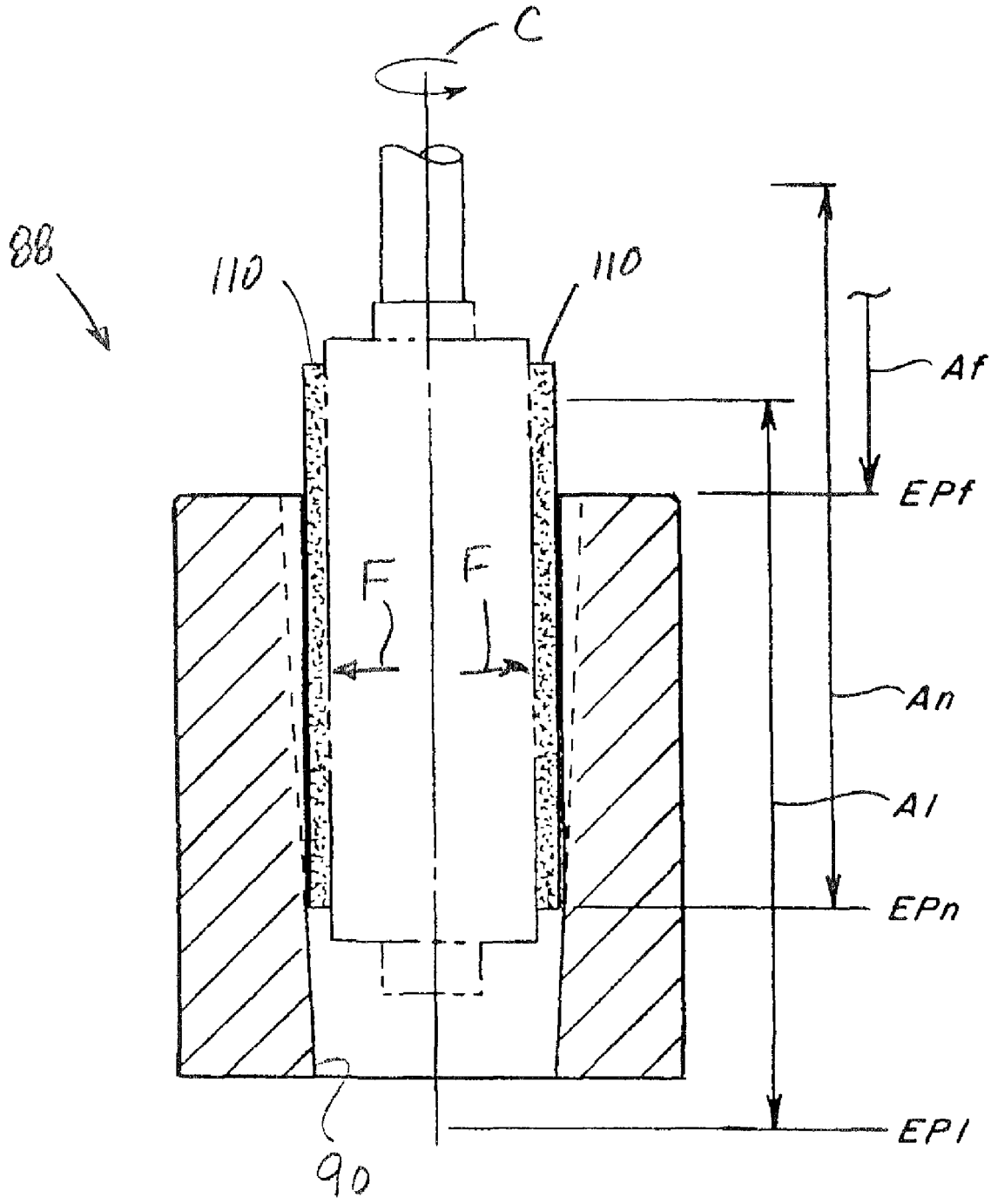
FIG. 36 is a sectional representation of a representative work piece having a tapered surface generated by honing according to the invention.
Figure 37:
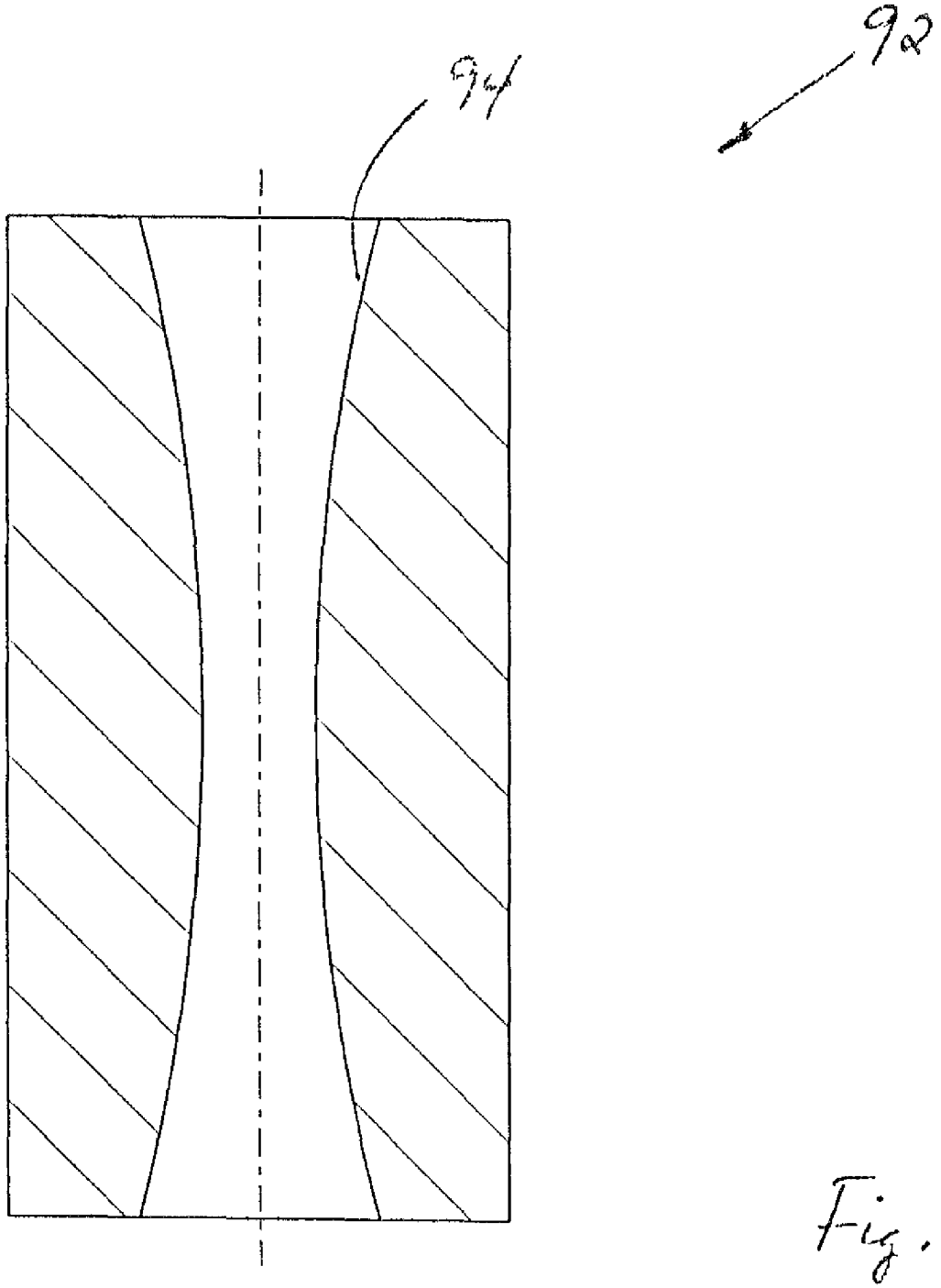
FIG. 37 is a sectional representation of a representative work piece having a dual bell mouthed or tapered surface generated by honing according to the invention.
Figure 38:
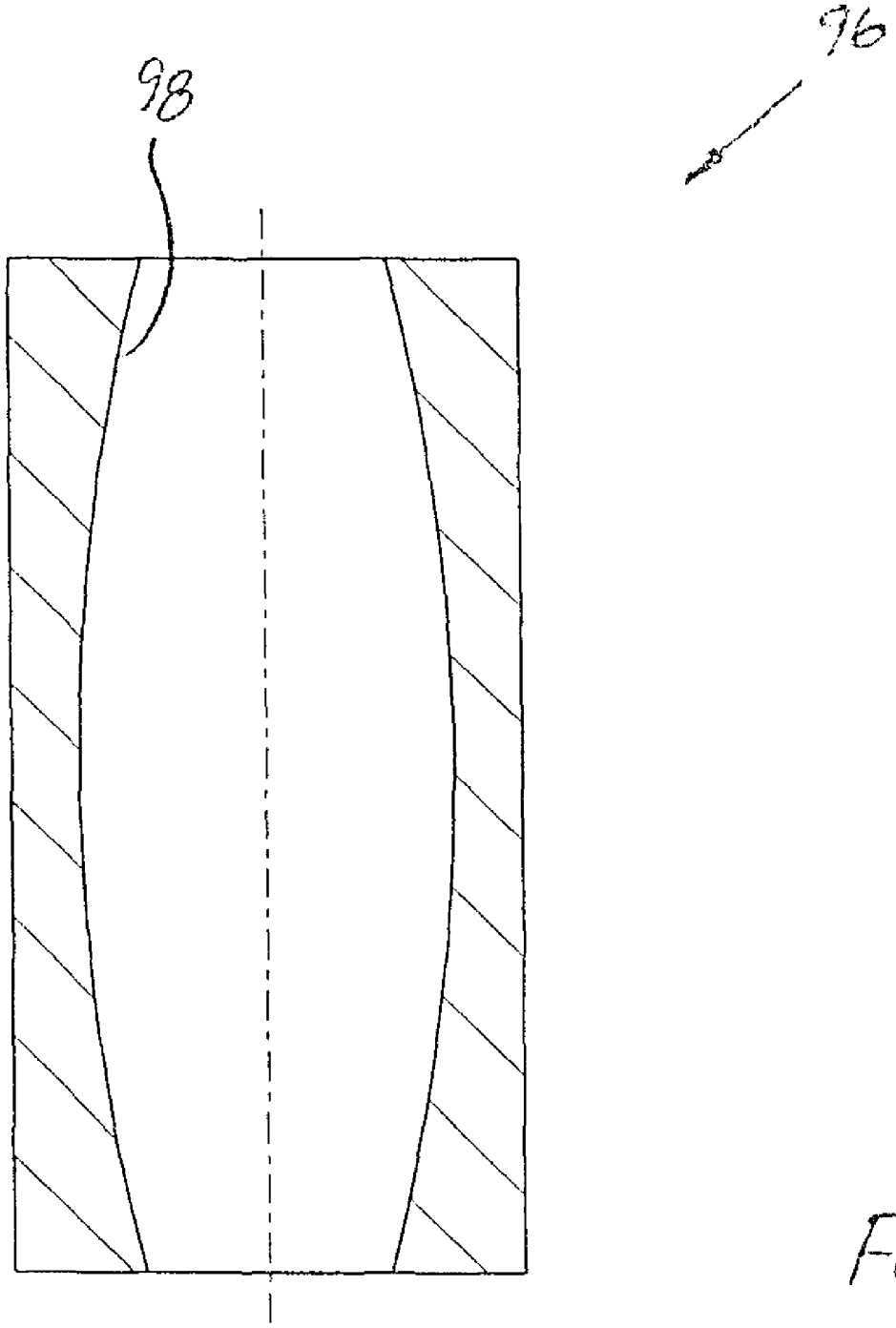
FIG. 38 is a sectional representation of a representative work piece having a barrel shaped surface generated by honing according to the invention.
Figures 39, 39A:
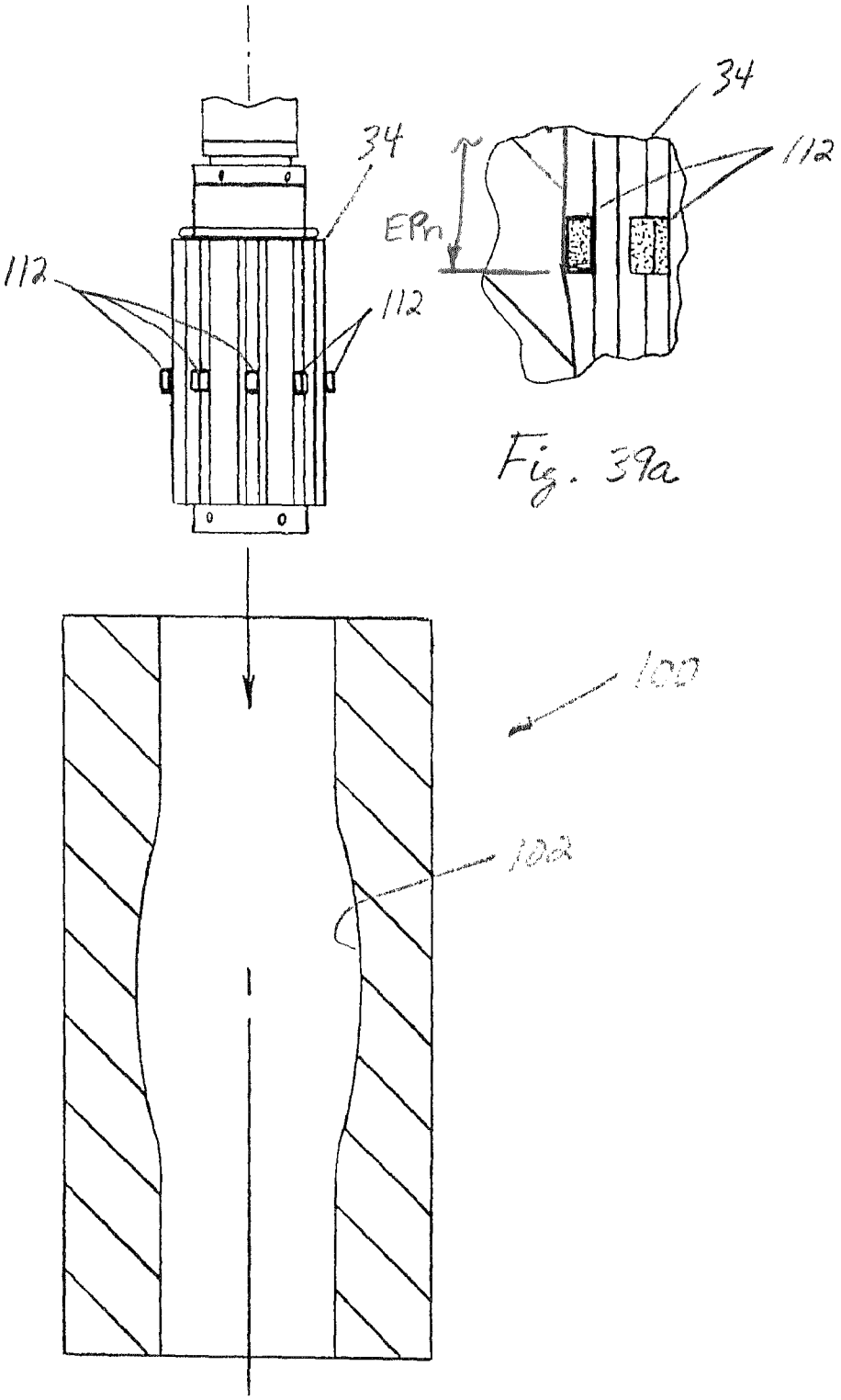
FIG. 39 is a sectional representation of another representative work piece having a barrel shaped surface generated by honing according to the invention, and a representative honing tool for generating the surface.
FIG. 39*a* is a fragmentary sectional representation showing the tool of FIG. 39 honing the surface.
Figure 40:
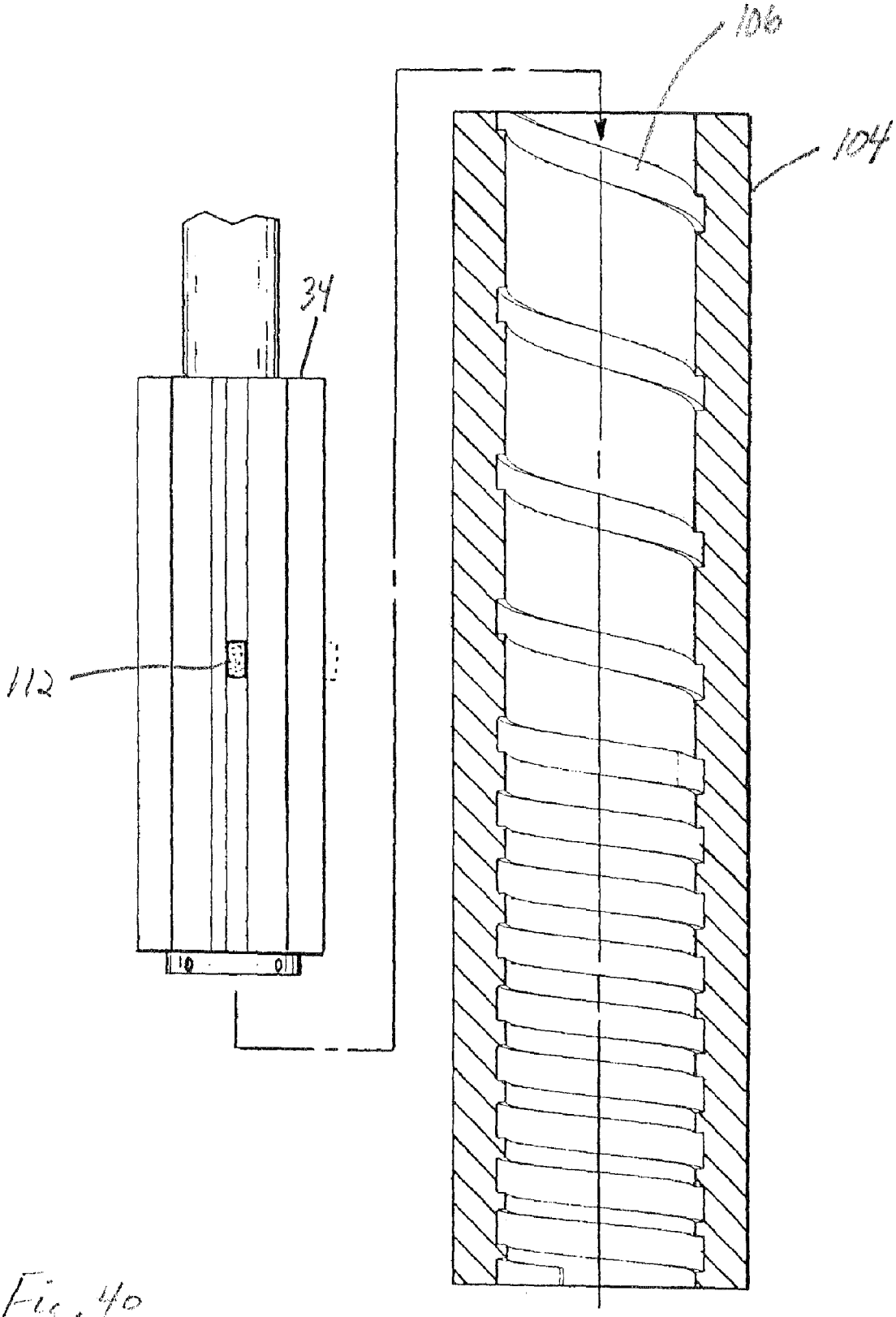
FIG. 40 is a sectional representation of a representative work piece having a helical grooved surface generated by honing according to the invention, and a representative honing tool for honing the surface.
Figure 41:
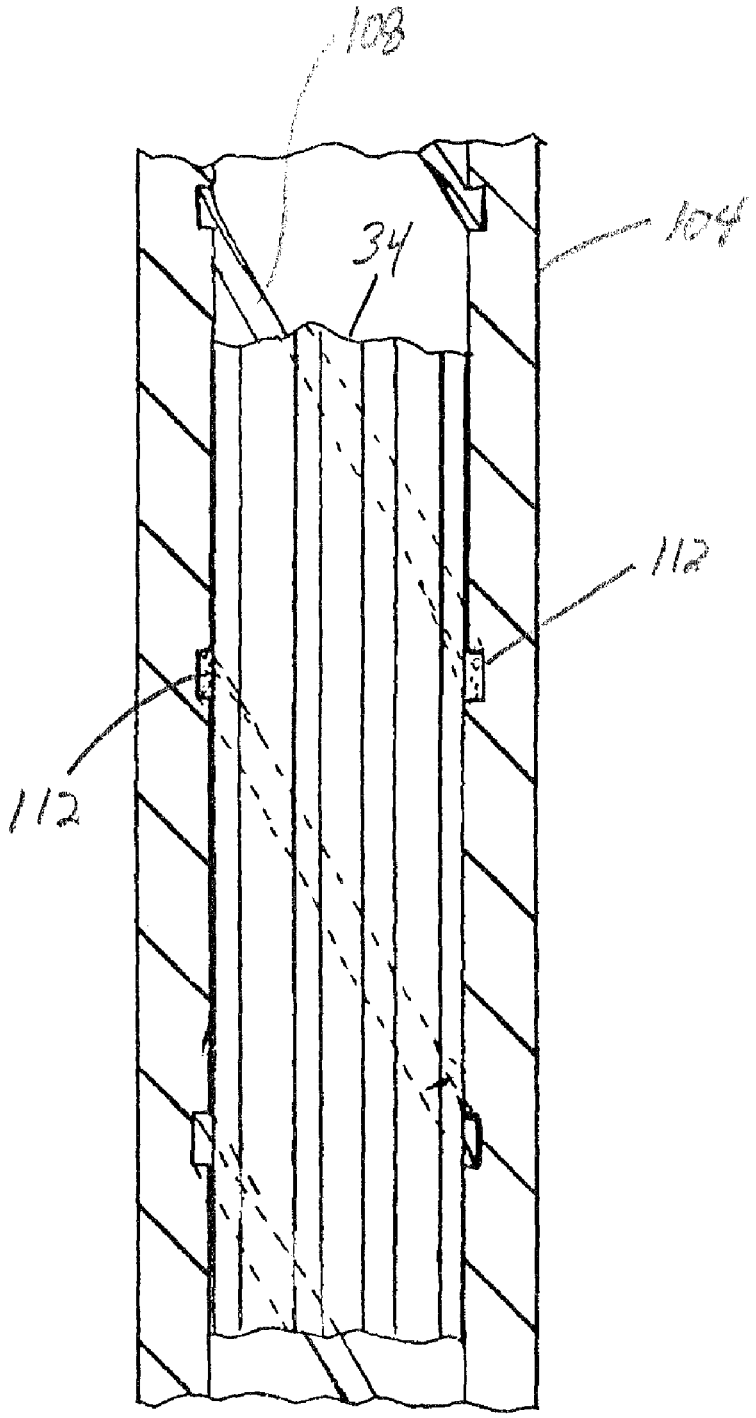
FIG. 41 is a fragmentary sectional representation of a representative work piece having a rifled surface generated by honing according to the invention, and a representative honing tool disposed in a bore or the work piece in position for honing the surface.

The servo drive systems and motion control profiles according to the invention just discussed can be used to accurately hone surfaces to a wide variety of non-cylindrical or special shapes, representative samples of which are illustrated in FIGS. 36 through 41. It should be noted that these shapes can be achieved by stroking movement of the tool relative to the work piece, or the work piece relative to the tool. It should also be noted that the lateral extents of the non-cylindrical shapes shown are exaggerated for purposes of illustration, and in actuality the lateral deviations from a cylindrical shape would typically be just a few thousandths or hundredths of an inch. Referring to FIG. 36, a work piece 88 having a surface 90 being honed to a tapered shape is illustrated; FIG. 37 illustrates a work piece 92 having a surface 94 honed to a double taper or hourglass shape; FIG. 38 illustrates a work piece 96 having a surface 98 honed to a barrel shape; FIG. 39 illustrates a work piece 100 having a surface 102 honed to a combination cylindrical and barrel shape; and FIGS. 40 and 41 illustrate a work piece 104 having a helical groove 106, and a helical groove 108, honed therein, respectively, all according to the present invention.

Referring more particularly to FIG. 36, a honing tool 34 is shown positioned in a bore of work piece 88 for honing surface 90 to a linear taper. Honing tool 34 is of conventional construction and operation, and will be stroked (arrows A) and rotated (arrow C) by honing machine 30 (see FIGS. 26, 28), as controlled by controller 46 using a suitable to one or more of the control profiles described above. Tool 34 includes a plurality of elongate abrasive honing elements 110 about its outer periphery, which will be fed laterally or radially outwardly under control of controller 46, as denoted by arrows F, as material is removed from surface 90. Controller 46 will model the honing process, with control of stroke position, length; feed position and/or force; and rotational speed. Tool 34 will have an initial stroke length denoted by arrow A1, extending downwardly to an end point EP1. This end point can be selected for imparting an initial cylindrical shape to surface 90 if desired. Then, to generate the taper, controller 46 will control the servo stroking apparatus using one or more of the motion profiles discussed above, to precisely change the lower end point of the stroking motion, progressively from a lower end point of the taper, which here coincides with the lower end of the work piece, through a range of intermediate end points EPn, to a final end point EPf, which here coincides with an upper end of the work piece. Here, its should be noted that by controlling the acceleration and deceleration of the honing tool in the above described manner, e.g., as shown in FIGS. 5, 9, 13, 17, 21, particularly at the end points, precise positional accuracy can be achieved.

The stroke lengths at each endpoint, e.g., EPn; Af at EPf, etc., can be equal, or they can be progressively shortened, as a function of the honing model. During the honing strokes, a constant feed force F can be maintained, or can be varied as required for achieving a desired result, e.g., feed position, according to the model. As other options, the progression of end points can additionally or alternatively be a function of material removed (change in feed position), feed rate, energy consumption, or other information gathered during the honing cycle or from a measuring or inspection step. As an example, power consumption information provided by the spindle drive, can be representative of resistance to rotation, and with feed position, can be used to deductively determine bore diameter at a desired stroking position or range of positions. Generally, a feed position at an in process end point of the honing stroke, e.g., end point EPn, will be representative of the diameter of the taper at that position along the length of the bore. If a constant honing cycle with progressively shortened honing strokes is used, generally, more material will be removed during the shorter strokes, and the controller can factor this information into the honing model.

To generate the non-linear hourglass shape 94 of FIG. 37, the steps just described can be utilized, with the tool being selected to have the necessary parameters, e.g., length and size, to enable progressively stroking the opposite ends of the bore to produce opposing, non-linear tapers. In this regard, the lower end points of the upper taper would be progressively moved upwardly, and the upper end points of the lower taper would be progressively moved to downwardly, as the target feed positions or diameters at the end points, are achieved.

The barrel shape surfaces 94, 98, and 102, can be generated according to the invention in a similar manner to the process just described, and using a tool 34 having axially shorter abrasive honing elements such as elements 112 shown in FIGS. 39 and 39*a*. To generate a barrel shape such as illustrated, the center of the stroke will remain at one position, that is, the axial center of the barrel shape, and both end points of the stroke will be gradually shortened toward the center, at the same rate if symmetrical, or at different rates if non-symmetrical. FIG. 39*a* illustrates a honing element 112 at an intermediate lower end point EPn of the honing stroke for generating the lower region of the barrel shape. Again, by controlling the stroking motion using the above described profiles of the invention, e.g., acceleration and deceleration of the honing tool as shown in FIGS. 5, 9, 13, 17, 21, particularly at the end points, and with continual increase of feed position, precise shapes such as this can be achieved.

The helical grooves 106 and 108 formed in work pieces 104 illustrate results obtainable by the precise stroking position and rotational positional accuracy that can be achieved according to the invention. Essentially, honing elements 112 will again be smaller, to enable achieving the relatively small groove size shown. Honing tool 34 including honing elements 112, or another tool, can also be used to hone the bore of work piece 104 to a cylindrical shape. When forming a helical groove, such as grooves 106 and 108, controller 46 of the associated honing machine 30 (FIGS. 26, 28) will control the spindle 58 to precisely control the rotational position of the tool to align honing element or elements 112 in the desired position of the helical groove. As the tool is stroked, the tool will be rotated in a controlled manner to form the groove or grooves. Rotational and stroking positional accuracy, and repeatability achievable using the control schemes of the invention described above, enable controlling tool 34 to follow the same helical path hundreds or thousands of times, with progressive feeding of honing element or elements 112 to deepen the groove or grooves to the desired depth. It should be observed that by changing the rotational speed and/or stroking speed, the pitch, or rate of twist of the helical groove or grooves can be varied, as illustrated by groove 106 in FIG. 40. Again, for either helical grooves, or other special shapes, it should be understood that the honing tool can be stroked relative to the work piece, or the work piece stroked relative to the honing tool, as desired or required for a particular application.

Thus, there has been shown and described a servo stroking apparatus and system, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A method of honing a surface extending about and defining at least a portion of a hole in a work piece to a predetermined non-cylindrical shape, comprising steps of:

providing a honing machine including at least one honing element supported for rotation about an axis;

providing a servo controlled stroking apparatus in connection with the at least one honing element and operable for moving the at least one honing element in a reciprocating axial stroking motion and generating stroke position information representative of an axial position of the at least one honing element;

providing a feed drive in connection with the at least one honing element and controllably operable for applying a feed force against the at least one honing element urging the at least one honing element laterally relative to the axis during the stroking motion, the feed drive being operable for generating at least feed position information representative of a lateral position of the at least one honing element;

providing a controller connected to an input device for receiving inputted commands and connected in operative control of the servo controlled stroking apparatus and the feed drive and for receiving the stroke position information and the feed position information, the controller being configured and programmable for automatically controlling the servo controlled stroking apparatus and the feed drive as a function of at least the inputted commands, the stroke position information, and the feed position information, to control acceleration and deceleration of the honing element and the axial position thereof including first and second end points of the stroking motion, and the feed position; and automatically controlling the servo controlled stroking apparatus during the stroking motion such that the acceleration and deceleration of the at least one honing element at and about at least the end points will have a combined profile which will limit a jerk profile of the motion to a finite value, while progressively changing at least one of the end points of the stroking motion and simultaneously automatically controlling the feed drive to vary the feed position, in a synchronized manner for honing the surface to the predetermined non-cylindrical shape.

2. The method of claim 1, wherein the at least one honing element comprises a portion of a honing tool.

3. The method of claim 1, wherein the servo controlled stroking apparatus comprises a ball screw mechanism.

4. The method of claim 1, wherein the servo controlled stroking apparatus comprises a linear motor.

5. The method of claim 1, wherein the servo controlled stroking apparatus comprises a fluid cylinder.

6. The method of claim 1, wherein the servo controlled stroking apparatus comprises a chain drive.

7. The method of claim 1, wherein the acceleration and deceleration of the at least one honing element will have the combined profile over substantially an entire length of the stroking motion thereof.

8. The method of claim 1, wherein the combined profile is selected from a group consisting of a simplified harmonic profile, a cycloidal profile, a modified trapezoidal profile, a polynomial profile, and a modified sine profile.

9. The method of claim 8, wherein the polynomial profile is selected from a group consisting of a 345 polynomial and a 4567 polynomial.

10. The method of claim 8, wherein the combined profile of the acceleration and deceleration of the honing element is a mix of at least two of the profiles of the group.

11. The method of claim 1, wherein the non-cylindrical shape comprises a tapered shape, and the step of progressively changing at least one of the end points of the stroking motion comprises progressively changing only one of the end points.

12. The method of claim 1, wherein the non-cylindrical shape comprises a barrel shape, and the step of progressively changing at least one of the end points of the stroking motion comprises progressively changing both of the end points.

13. The method of claim 1, wherein the non-cylindrical shape comprises an hourglass shape.

14. The method of claim 1, comprising a step of honing the surface to a cylindrical shape prior to the step of honing the surface to the non-cylindrical shape.

15. The method of claim 1, wherein the step of automatically controlling the feed drive to vary the feed position is performed to maintain the feed force substantially constant.

16. The method of claim 1, wherein the step of automatically controlling the feed drive to vary the feed position is performed to vary the feed force in a predetermined manner.

17. The method of claim 1, wherein the reciprocating strokes of the stroking motion will be of equal duration.

* * * * *

UNITED STATES PATENT AND TRADEMARK OFFICE

CERTIFICATE OF CORRECTION

PATENT NO. : 8,348,718 B2
APPLICATION NO. : 12/778045
DATED : January 8, 2013
INVENTOR(S) : Jose L. Martin et al.

It is certified that error appears in the above-identified patent and that said Letters Patent is hereby corrected as shown below:

Column 3, line 2, delete "to".

Column 3, line 52, delete "to".

Column 5, line 67, delete "to".

Column 8, line 4, delete "to".

Column 8, line 45, delete the first occurrence of "to".

Column 9, line 24, delete "to".

Column 11, line 35, delete "to".

Column 12, line 15, delete "to".

Column 13, line 49, delete "to".

Column 14, line 31, delete "to".

Signed and Sealed this
Twelfth Day of February, 2013

Teresa Stanek Rea
*Acting Director of the United States Patent and Trademark Office*